US007162047B2

(12) United States Patent
Yamada et al.

(10) Patent No.: US 7,162,047 B2
(45) **Date of Patent: *Jan. 9, 2007**

(54) AUDIO REPRODUCING APPARATUS

(75) Inventors: Yuji Yamada, Tokyo (JP); Koyuru Okimoto, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/343,553

(22) Filed: Jan. 31, 2006

(65) Prior Publication Data

US 2006/0126871 A1 Jun. 15, 2006

Related U.S. Application Data

(63) Continuation of application No. 10/390,328, filed on Mar. 17, 2003, now Pat. No. 7,043,036.

(30) Foreign Application Priority Data

Mar. 18, 2002 (JP) ..... 2002-073923

(51) Int. Cl.
*H04R 5/02* (2006.01)
*H04R 1/10* (2006.01)

(52) U.S. Cl. ..... 381/309; 381/310; 381/74

(58) Field of Classification Search ..... 381/309, 381/310, 17, 74

See application file for complete search history.

(56) References Cited

U.S. PATENT DOCUMENTS

| | | | |
|---|---|---|---|
| 5,757,931 | A | 5/1998 | Yamada et al. |
| 6,026,169 | A | 2/2000 | Fujimori |
| 6,385,320 | B1 | 5/2002 | Lee |
| 6,590,983 | B1 | 7/2003 | Kramer |
| 2002/0048378 | A1 | 4/2002 | Oki |

OTHER PUBLICATIONS

Prior Art, Figures 24 and 25, p. 5, line 20 and p. 7, line 3.

*Primary Examiner*—Vivian Chin
*Assistant Examiner*—Devona E. Faulk
(74) *Attorney, Agent, or Firm*—Wolf, Greenfield & Sacks, P.C.

(57) ABSTRACT

In an audio reproducing apparatus, first and second filters convolute impulse responses corresponding to transfer functions from a position where a right-hand sound source is located to the right and left ears of the listener into an audio signal, respectively, and third and fourth filters convolute impulse responses corresponding to transfer functions from a position where a left-hand sound source is located to the right and left ears of the listener into another audio signal, respectively. Fifth and sixth filters extract low-frequency components of the audio signal, and seventh and eighth filters extract low-frequency components of the another audio signal. The output signals of the first, third, fifth, and seventh filters are added, and the output signals of the second, fourth, the sixth, and eighth filters are added.

3 Claims, 19 Drawing Sheets

$$SL = HL \times SO = \frac{HOL \times HRR - HOR \times HRL}{HLL \times HRR - HLR \times HRL} \times SO \quad \cdots \quad (1)$$

$$SR = HR \times SO = \frac{HOR \times HLL - HOL \times HLR}{HLL \times HRR - HLR \times HRL} \times SO \quad \cdots \quad (2)$$

AUDIO REPRODUCING APPARATUS

CROSS REFERENCES TO RELATED APPLICATIONS

This application is a continuation of application Ser. No. 10/390,328, filed on Mar. 17, 2003, now U.S. Pat. No. 7,043,036, entitled "Audio Reproducing Apparatus."

BACKGROUND OF THE INVENTION

1. Field of the Invention

The present invention relates to apparatuses for reproducing sound by headphones or speakers with the sound image(s) being located at any position(s) outside the head of a listener or around the listener.

2. Description of the Related Art

In recent years, multi-channel audio signals have been used frequently for sound which accompanies video such as movies, and are recorded on the assumption that the sound is reproduced by speakers disposed at both sides and the center of a screen or a display where the video is displayed, and by speakers disposed after or both sides of the listeners. With this, the sound source in the video matches the sound image from which the sound apparently comes, and a sound field having a normal range is obtained.

When such sound is reproduced by headphones, however, the sound image produced by an input audio signal is located in the head of the listener, the video position does not match the sound-image locating position, the sound image is located at a position extremely strange, and the sound-image locating position of an each-channel audio signal cannot be independently separated.

Even when only multi-channel sound such as music is listened to, if the sound is reproduced by headphones, unlike a case in which the sound is reproduced by speakers, the reproduced sound image is located in the head of the listener, the sound-image locating positions of the multi-channel audio signal are not separated, and a sound field extremely strange is obtained.

Therefore, in a case in which sound is reproduced by headphones, an idea has been examined in which the sound images are located at any potions outside the head of the listener to provide the same sound field as that obtained when speakers are disposed at those positions.

FIG. 22 shows the principle of the idea in a case in which two-channel stereo sound is reproduced by headphones with the sound images thereof being located at any positions outside the head of the listener, for example, at right-hand and left-hand positions symmetrical against the center plane before the listener.

In this case, transfer functions (frequency responses) HRR and HRL from a sound source 5R where the sound image is located to the right and left ears 1R and 1L of the listener 1, and transfer functions HLR and HLL from a sound source 5L where the sound image is located to the right and left ears 1R and 1L of the listener 1 are obtained in advance by calculation or by measurement in which right-hand and left-hand speakers are disposed at the positions of the sound sources 5R and 5L and right-hand and left-hand sound output therefrom is measured at the positions of the right and left ears 1R and 1L of the listener 1.

FIG. 24 shows a conventional audio reproducing apparatus used for the case shown in FIG. 22. Right-hand-side and left-hand-side analog audio signals Ar and Al corresponding to the signals of the sound sources 5R and 5L shown in FIG. 22 are input to terminals 11R and 11L, and are converted to digital audio signals Dr and Dl by A/D converters 12R and 12L, the digital audio signal Dr is sent to digital filters 21RR and 21RL, and the digital audio signal Dl is sent to digital filters 21LR and 21LL.

The digital filters 21RR and 21RL convolute impulse responses to which the transfer functions HRR and HRL are converted in a time domain, into the digital audio signal Dr. The digital filters 21LR and 21LL convolute impulse responses to which the transfer functions HLR and HLL are converted in a time domain, into the digital audio signal Dl.

An adder circuit 22R adds the output signals DRR and DLR of the digital filters 21RR and 21LR. An adder circuit 22L adds the output signals DRL and DLL of the digital filters 21RL and 21LL. The output digital audio signals DR and DL of the adder circuits 22R and 22L are converted to analog audio signals by D/A converters 13R and 13L. The two-path analog audio signals are amplified by audio amplifier circuits 14R and 14L, and sent to the right-hand and left-hand acoustic transducers 3R and 3L of headphones 3.

Therefore, in the audio reproducing apparatus shown in FIG. 24, the transfer functions HRR and HRL are demonstrated through the paths of the digital filters 21RR and 21RL, and the transfer functions HLR and HLL are demonstrated through the paths of the digital filters 21LR and 21LL to locate the sound images of the right-hand and left-hand input audio signals Dr and Dl at the positions of the sound sources 5R and 5L.

When sound is reproduced by speakers, a speaker layout is usually restricted. A limited number of listeners can place a great number of speakers for reproducing multi-channel sound in their listening rooms.

Therefore, an idea has been examined in which a great number of sound images produced by multi-channel input audio signals are located at any positions around the listener by a small number of speakers, for example, by two speakers.

FIG. 23 shows the principle of the idea in a case in which speakers 6R and 6L are disposed at right-hand-side and left-hand-side positions symmetrical against the center plane before the listener and the sound image of an input audio signal SO is located at any position around the listener, for example, at a left-hand rear position indicated by a sound source 7.

In this case, the relationships between the input audio signal SO, which is the signal of the sound source 7, and driving signals SR and SL for the speakers 6R and 6L are expressed as follows:

$$SL=HL\times SO \tag{1}$$

$$SR=HR\times SO \tag{2}$$

HR and HL indicate transfer functions expressed by the terms to be multiplied by the signal SO in expressions (1) and (2), and are functions of transfer functions HRR and HRL from the speaker 6R to the right and left ears 1R and 1L of the listener 1, transfer functions HLR and HLL from the speaker 6L to the right and left ears 1R and 1L of the listener 1, and transfer functions HOR and HOL from the sound source 7 to the right and left ears 1R and 1L of the listener 1, with cancellation of a cross talk between the speakers 6R and 6L being taken into account. The transfer functions HRR, HRL, HLR, HLL, HOR, and HOL are measured or calculated in advance.

FIG. 25 shows a conventional audio reproducing apparatus used for the case shown in FIG. 23. An analog audio signal Ai is input to a terminal 11, and is converted to a digital audio signal Di by an A/D converter 12, the digital audio signal Di is sent to digital filters 21R and 21L.

The digital filters 21R and 21L convolute impulse responses to which the transfer functions HR and HL are converted in a time domain, into the digital audio signal Di.

The output digital audio signals DHR and DHL of the digital filters 21R and 21L are converted to analog audio signals by D/A converters 13R and 13L. The two-path analog audio signals are amplified by audio amplifier circuits 14R and 14L, and sent to the speakers 6R and 6L.

Therefore, in the audio reproducing apparatus shown in FIG. 25, the transfer functions HR and HL are demonstrated through the paths of the digital filters 21R and 21L to locate the sound image of the input audio signal SO (Di) at the position of the sound source 7.

FIG. 25 shows a case in which the sound image of a one-channel audio signal is located at one sound-source position. When a sound-image-locating signal processing section formed of the two digital filters 21R and 21L shown in FIG. 25 is provided for each of multi-channel audio signals, a great number of sound images produced by the multi-channel audio signals can be located at any positions around the listener by the two speakers 6R and 6L.

In the conventional audio reproducing apparatuses shown in FIG. 24 and FIG. 25, the digital filters 21RR, 21RL, 21LR, 21LL, and 21R and 21L convolute impulse responses, such as that shown in FIG. 2, to which the transfer functions HRR, HRL, HLR, HLL, and HR and HL are converted in the time domain, respectively, and are formed of a finite-impulse-response (FIR) filter such as that shown in FIG. 3.

In this case, more specifically, the input audio signal Di (Dr or Dl) is sequentially delayed by delay circuits 51 connected in multiple stages, each having a delay time of the sampling period ($\tau$) of the input audio signal. Each multiplier circuit 52 multiplies the input audio signal Di (Dr or Dl) or the output signal of each delay circuit 51 by a coefficient corresponding to the impulse response thereof at each sampling period $\tau$. Each adder circuit 53 sequentially adds the output signal of each multiplier circuit 52 to obtain the output audio signal DHR (DRR or DRL) or DHL (DLR or DLL) after filtering.

The digital filters 21RR and 21RL, 21LR and 21LL, or 21R and 21L may be formed, as shown in FIG. 4, of a structure in which delay circuits 51 are shared, a multiplier circuit 52 and an adder circuit 53 form one digital filter, and a multiplier circuit 54 and an adder circuit 55 form the other digital filter.

In this case, however, if the impulse response such as that shown in FIG. 2 is not sufficiently extended in time for an input audio signal for each channel, reproducibility deteriorates especially at low frequencies of several hundred Hz and lower, and a clear feeling of sound-image locating is not obtained at the low frequencies.

When the numbers of orders (taps) of impulse-response-convolution digital filters are increased, for example, when the number of stages of the delay circuits 51 in an FIR filter, such as that shown in FIG. 3 or FIG. 4, is increased, the impulse response is extended in time.

Then, however, when the sound-image-locating signal processing section is formed of hardware, the circuit scale becomes huge, and when the sound-image-locating signal processing section is formed of hardware and software (program) like a digital signal processor (DSP), a huge amount of calculation is required.

SUMMARY OF THE INVENTION

The present invention has been made in consideration of the foregoing points. It is an object of the present invention to suppress the circuit scale and the amount of calculation of a signal processing section for locating the reproduced sound image of an input audio signal at any position outside the head of the listener or around the listener to allow the reproduced sound image to be clearly located even if the circuit scale and the amount of calculation are suppressed.

The foregoing object is achieved in one aspect of the present invention through the provision of an audio reproducing apparatus including first filtering means for convoluting into an input audio signal, an impulse response to which a transfer function from a position where the sound image of the input audio signal is located to the left ear of a listener is converted on a time domain; second filtering means for convoluting into the input audio signal, an impulse response to which a transfer function from the position where the sound image of the input audio signal is located to the right ear of the listener is converted on the time domain; third filtering means for extracting a low-frequency component from the input audio signal; first adder means for adding the output signal of the third filtering means to the output signal of the first filtering means to obtain a first output audio signal; and second adder means for adding the output signal of the third filtering means to the output signal of the second filtering means to obtain a second output audio signal.

In the audio reproducing apparatus having the above-described structure, according to the present invention, since the low-frequency component of the input audio signal, which is the output signal of the third filtering means, is added to each of the output signals of the first and second filtering means, the level difference between the frequency characteristics of the impulse responses produced by the first and second filtering means becomes slight at low frequencies, and a clear feeling of sound-image locating is obtained at the low frequencies.

The foregoing object is achieved in another aspect of the present invention through the provision of an audio reproducing apparatus including first filtering means for convoluting into an input audio signal, an impulse response to which a transfer function from a position where the sound image of the input audio signal is located to the left ear of a listener is converted on a time domain; first reverberating means for performing a reverberation processing to the output signal of the first filtering means; second filtering means for convoluting into the input audio signal, an impulse response to which a transfer function from the position where the sound image of the input audio signal is located to the right ear of the listener is converted on the time domain; second reverberating means for performing a reverberation processing to the output signal of the second filtering means; third filtering means for extracting a low-frequency component from the input audio signal; first adder means for adding the output signal of the third filtering means to the output signal of the first reverberating means to obtain a first output audio signal; and second adder means for adding the output signal of the third filtering means to the output signal of the second reverberating means to obtain a second output audio signal.

The foregoing object is achieved in still another aspect of the present invention through the provision of an audio reproducing apparatus including down-sampling means for down-sampling an input digital audio signal to generate a digital audio signal having a sampling frequency lower than the sampling frequency of the input digital audio signal; first filtering means for convoluting into the down-sampled digital audio signal, an impulse response to which a transfer function from a position where the sound image of the digital audio signal is located to the left ear of a listener is converted on a time domain; first over-sampling means for converting the sampling frequency of the output signal of the first filtering means to the sampling frequency of the input digital audio signal; second filtering means for convoluting into the down-sampled digital audio signal, an impulse response to which a transfer function from the position where the sound image of the digital audio signal is located to the right ear of the listener is converted on the time domain; second over-sampling means for converting the sampling frequency of the output signal of the second filtering means to the sampling frequency of the input digital audio signal; third filtering means for extracting at least a low-frequency component from the input digital audio signal; first adder means for adding the output signal of the third filtering means to the output signal of the first over-sampling means to obtain a first output audio signal; and second adder means for adding the output signal of the third filtering means to the output signal of the second over-sampling means to obtain a second output audio signal.

The foregoing object is achieved in yet another aspect of the present invention through the provision of an audio reproducing apparatus including a band-restriction filter for extracting a frequency component having a predetermined frequency or lower from an input audio signal; first filtering means for convoluting into the output audio signal of the band-restriction filter, an impulse response to which a transfer function from a position where the sound image of the output audio signal is located to the left ear of a listener is converted on a time domain; second filtering means for convoluting into the output audio signal of the band-restriction filter, an impulse response to which a transfer function from the position where the sound image of the output audio signal is located to the right ear of the listener is converted on the time domain; third filtering means for extracting a low-frequency component from the input audio signal; first adder means for adding the output signal of the third filtering means to the output signal of the first filtering means to obtain a first output audio signal; and second adder means for adding the output signal of the third filtering means to the output signal of the second filtering means to obtain a second output audio signal.

DESCRIPTION OF THE PREFERRED EMBODIMENTS

[First Embodiment: FIG. 1 to FIG. 11]

A case in which a low-frequency component is extracted from an input audio signal and added to an impulse-response-output audio signal will be described according to a first embodiment.

[Monaural Reproduction by Headphones with FIG. 1 to FIG. 9]

Figure 1:
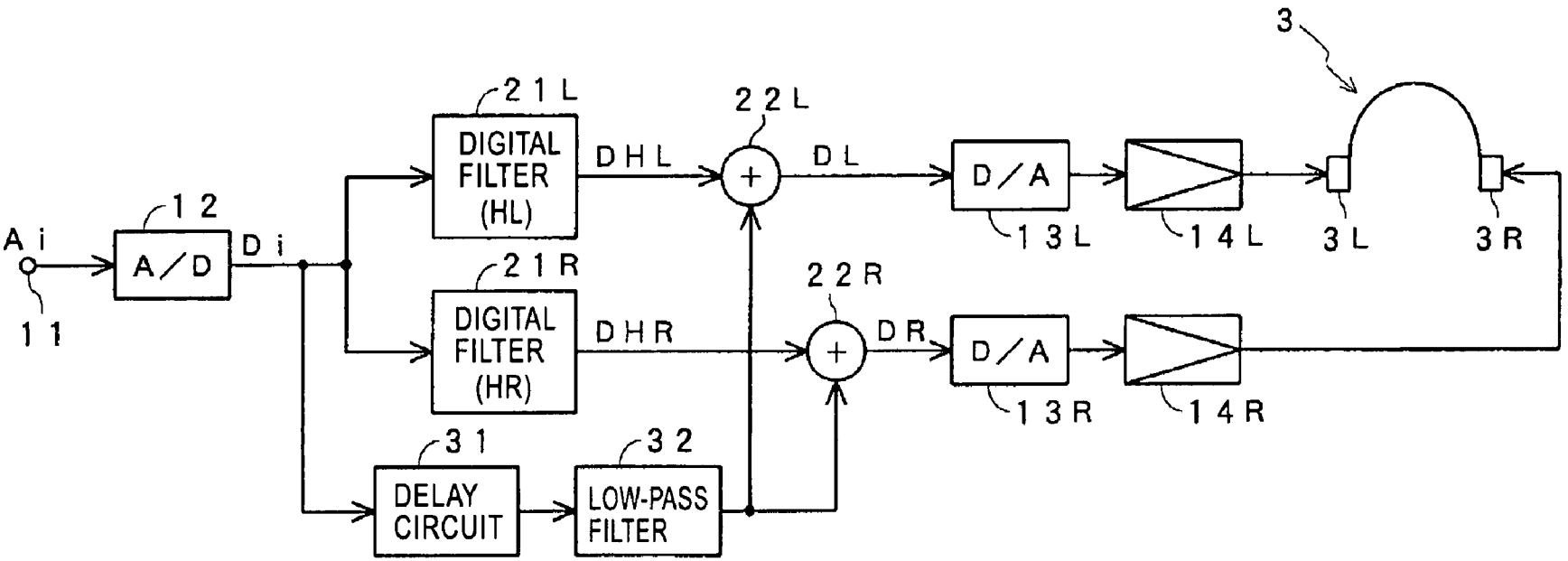
FIG. 1 is a block diagram of a first audio reproducing apparatus according to a first embodiment of the present invention.
Figure 21:
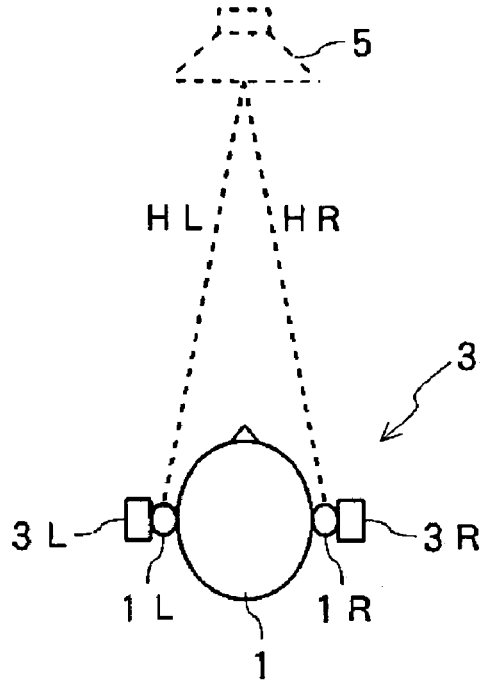
FIG. 21 is a view showing the principle of a case in which a sound image is located at any position outside the head of the listener.

FIG. 1 shows a case according to the first embodiment, in which one-channel sound is reproduced by headphones with the sound image thereof being located at any position outside the head of the listener, for example, at a position on the center plane before the listener, as shown in FIG. 21.

In this case, transfer functions HR and HL from a sound source 5 where the sound image is to be located, to the right and left ears 1R and 1L of the listener 1 are measured or calculated in advance.

In the case shown in FIG. 1, an analog audio signal Ai which corresponds to a signal of the sound source 5 shown in FIG. 21 is input to a terminal 11 and is converted to a digital audio signal Di by an A/D converter 12, and the digital audio signal Di is sent to digital filters 21R and 21L.

Figure 2:
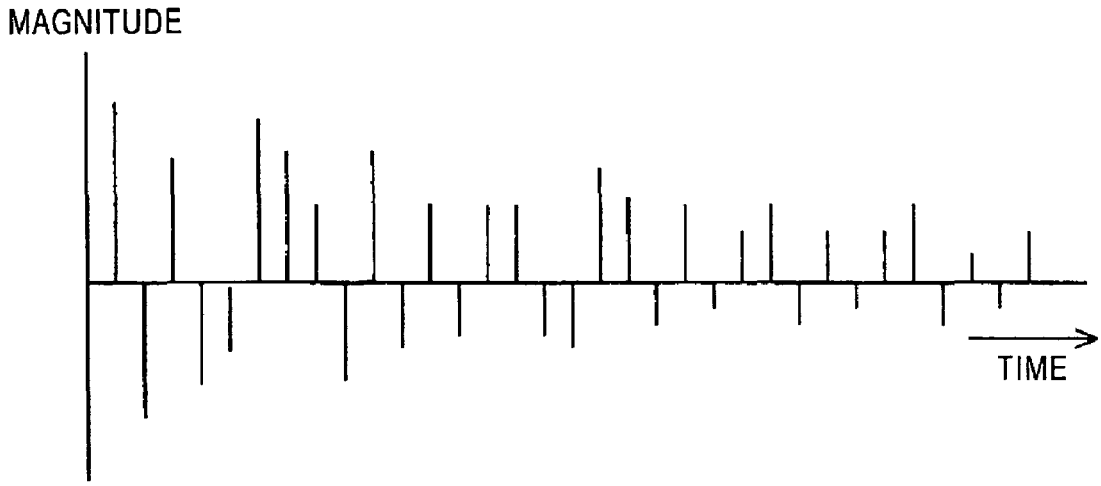
FIG. 2 is a view showing an example impulse response.

The digital filters 21R and 21L convolute impulse responses, such as that shown in FIG. 2, to which the transfer functions HR and HL are converted in a time domain, into the digital audio signal Di.

Figure 3:
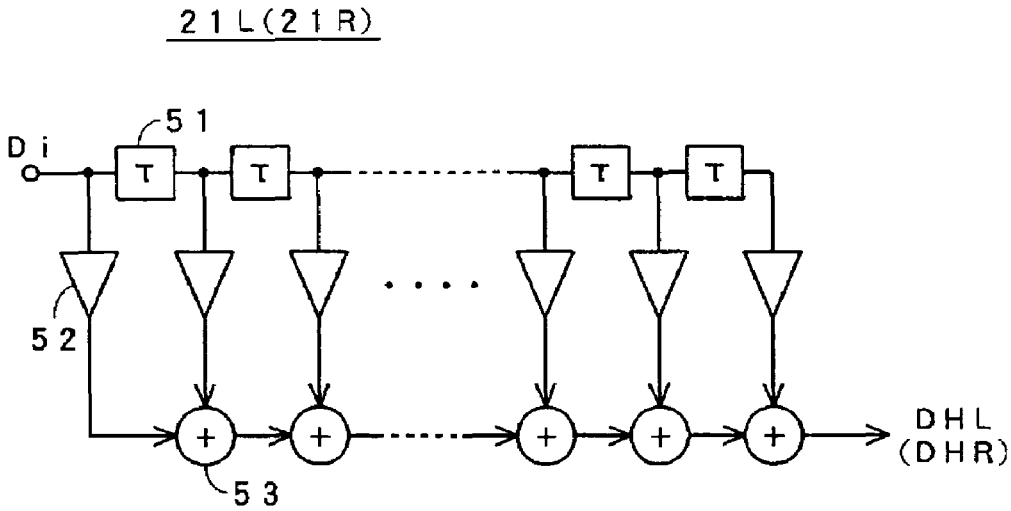
FIG. 3 is a view showing an example digital filter for convoluting an impulse response.

Specifically, the digital filters 21R and 21L can be formed of a finite-impulse-response (FIR) filter shown in FIG. 3.

In this case, more specifically, the input audio signal Di is sequentially delayed by delay circuits 51 connected in multiple stages, each having a delay time of the sampling period ($\tau$) of the input audio signal. Each multiplier circuit 52 multiplies the input audio signal Di or the output signal of each delay circuit 51 by a coefficient corresponding to the impulse response. Each adder circuit 53 sequentially adds the output signal of each multiplier circuit 52 to obtain the output audio signal DHR or DHL after filtering.

Figure 4:
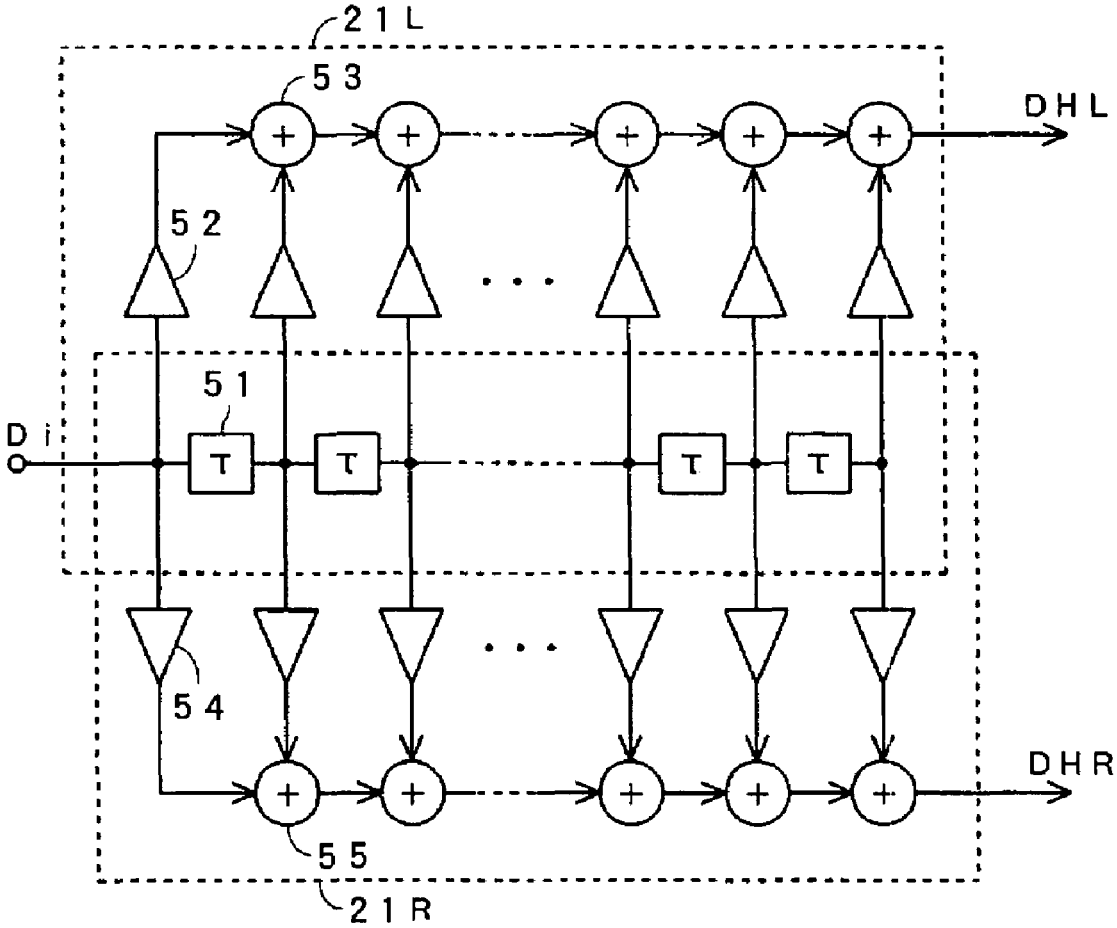
FIG. 4 is a view showing another example digital filter for convoluting an impulse response.

The digital filters 21R and 21L may have, as shown in FIG. 4, a structure in which delay circuits 51 are shared, multiplier circuits 52 and adder circuits 53 form the digital filter 21L, and multiplier circuits 54 and adder circuits 55 form the digital filter 21R.

The digital filters 21R and 21L are indicated as hardware circuits in a function-block manner in FIG. 3 and FIG. 4, but they can be configured such that they include software (program) like a digital signal processor (DSP), as sound-image-locating signal processing sections.

In the case shown in FIG. 1, if the impulse responses produced by the digital filters 21R and 21L are not sufficiently extended in time, that is, if the numbers of orders (taps) of the digital filters 21R and 21L are not large, reproducibility is improved at low frequencies, and a clear feeling of sound-image locating is obtained at the low frequencies.

To this end, in the case shown in FIG. 1, the digital audio signal Di output from the A/D converter 12 is delayed by a delay circuit 31 so as to match in time the output signals DHR and DHL of the digital filters 21R and 21L, and is sent to a low-pass filter 32, and a low-frequency component, described later, is extracted from the digital audio signal Di by the low-pass filter 32.

Then, an adder circuit 22R adds the output signal of the low-pass filter 32 to the output signal DHR of the digital filter 21R. An adder circuit 22L adds the output signal of the low-pass filter 32 to the output signal DHL of the digital filter 21L. The output digital audio signals DR and DL of the adder circuits 22R and 22L are converted to analog audio signals by D/A converters 13R and 13L. The two-path analog audio signals are amplified by audio amplifier circuits 14R and 14L, and sent to the right-hand and left-hand acoustic transducers 3R and 3L of headphones 3.

Figure 5A:
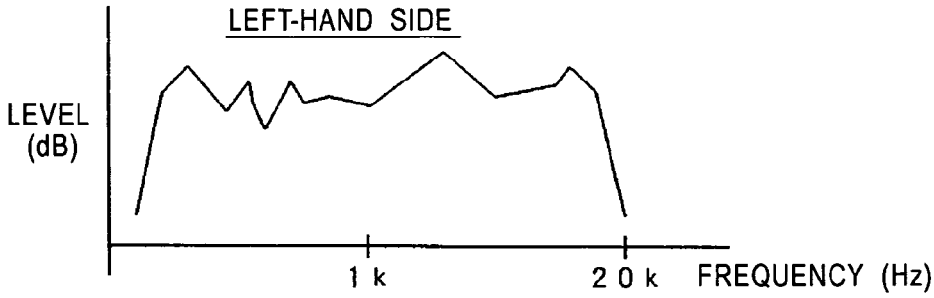
FIG. 5A and FIG. 5B are views showing the frequency characteristics of example impulse responses measured in a general listening room.
Figure 5B:
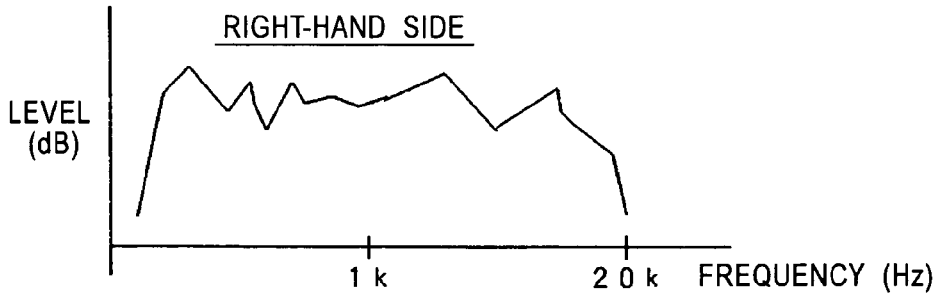

As shown in FIG. 5B and FIG. 5A, in the frequency characteristics of impulse responses from an actual sound source to the right and left ears of the listener, measured in a general listening room, especially at low frequencies of several hundred Hz and lower, there is no large level difference between the impulse response from the sound source to the right ear and the impulse response from the sound source to the left ear.

Figure 6A:
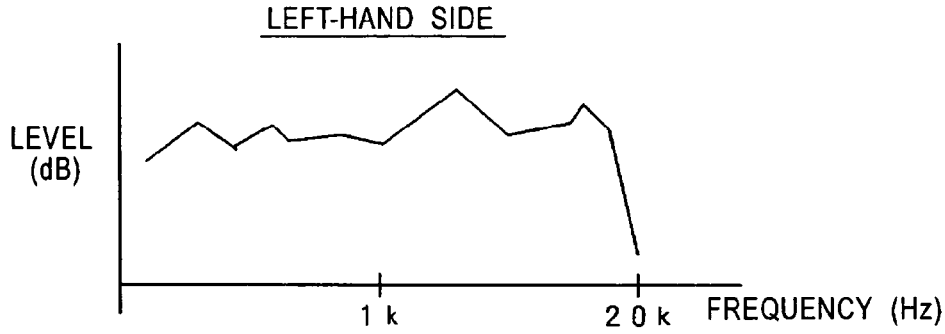
FIG. 6A and FIG. 6B are views showing the frequency characteristics of example impulse responses obtained when the numbers of orders of digital filters for convoluting impulse responses are restricted.
Figure 6B:
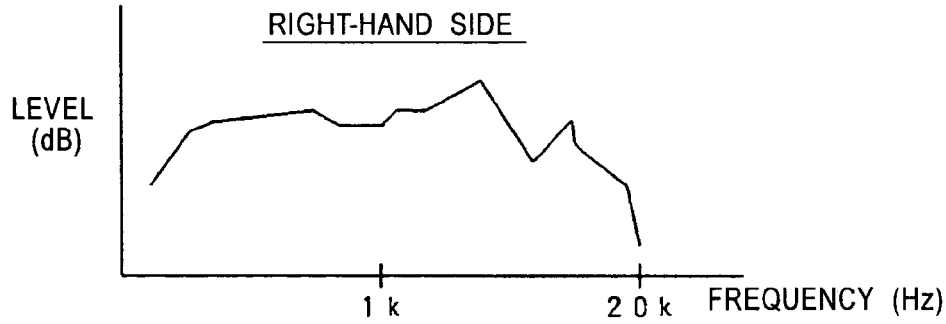

In contrast, when the orders of the digital filters 21R and 21L are limited as described above, the frequency characteristics of the impulse responses produced by the digital filters 21R and 21L are different from the actual frequency characteristics shown in FIG. 5B and FIG. 5A especially at low frequencies of several hundred Hz and lower, as shown in FIG. 6B and FIG. 6A, and there is a large level difference in some cases between the right-hand-side impulse response produced by the digital filter 21R and the right-hand-side impulse response produced by the digital filter 21L.

Therefore, when the output signals DHR and DHL of the digital filters 21R and 21L are, as they are, converted to the analog audio signals by the D/A converters 13R and 13L, and sent to the acoustic transducers 3R and 3L of the headphones 3, reproducibility deteriorates especially at low frequencies of several hundred Hz and lower, and a clear feeling of sound-image locating is not obtained at the low frequencies.

Figure 7:
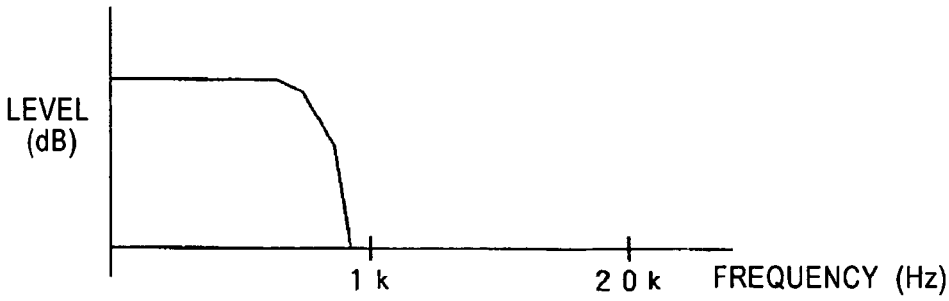
FIG. 7 is a view showing the frequency characteristic of an example low-pass filter.

In the case shown in FIG. 1, however, the low-pass filter 32 has a frequency characteristic such that a low-frequency component having frequencies of several hundred Hz and lower is extracted at a constant level as shown in FIG. 7, and the output signal of the low-pass filter 32 is added to the output signals DHR and DHL of the digital filters 21R and 21L.

Figure 8A:
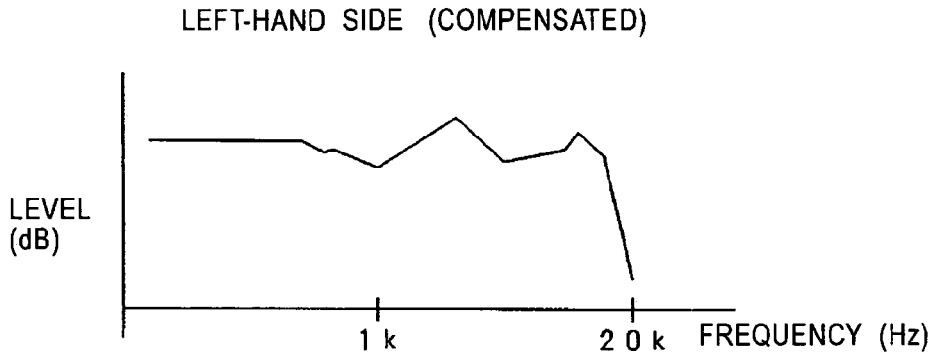
FIG. 8A and FIG. 8B are views showing the frequency characteristics of example digital audio signals compensated for by a low-pass filter.
Figure 8B:
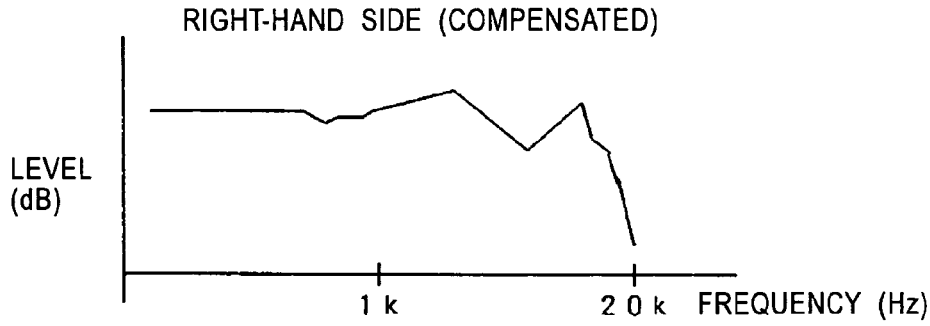

When the output signal level of the low-pass filter 32 is set relatively higher than the output signal levels of the digital filters 21R and 21L, the output signal of the low-pass filter 32 becomes dominant at low frequencies of several hundred Hz and lower in the frequency characteristics of the output signals DR and DL of the adder circuits 22R and 22L as shown in FIG. 8B and FIG. 8A. There is a slight level difference between the output signal DR of the adder circuit 22R and the output signal DL of the adder circuit 22L, and a clear feeling of sound-image locating is obtained at the low frequencies.

At the same time, attenuation and a level difference caused by the restriction on the numbers of orders of the digital filters 21R and 21L at the low frequencies are reduced by the output signal of the low-pass filter 32, and the deterioration of sound quality is reduced at the low frequencies.

Figure 9:
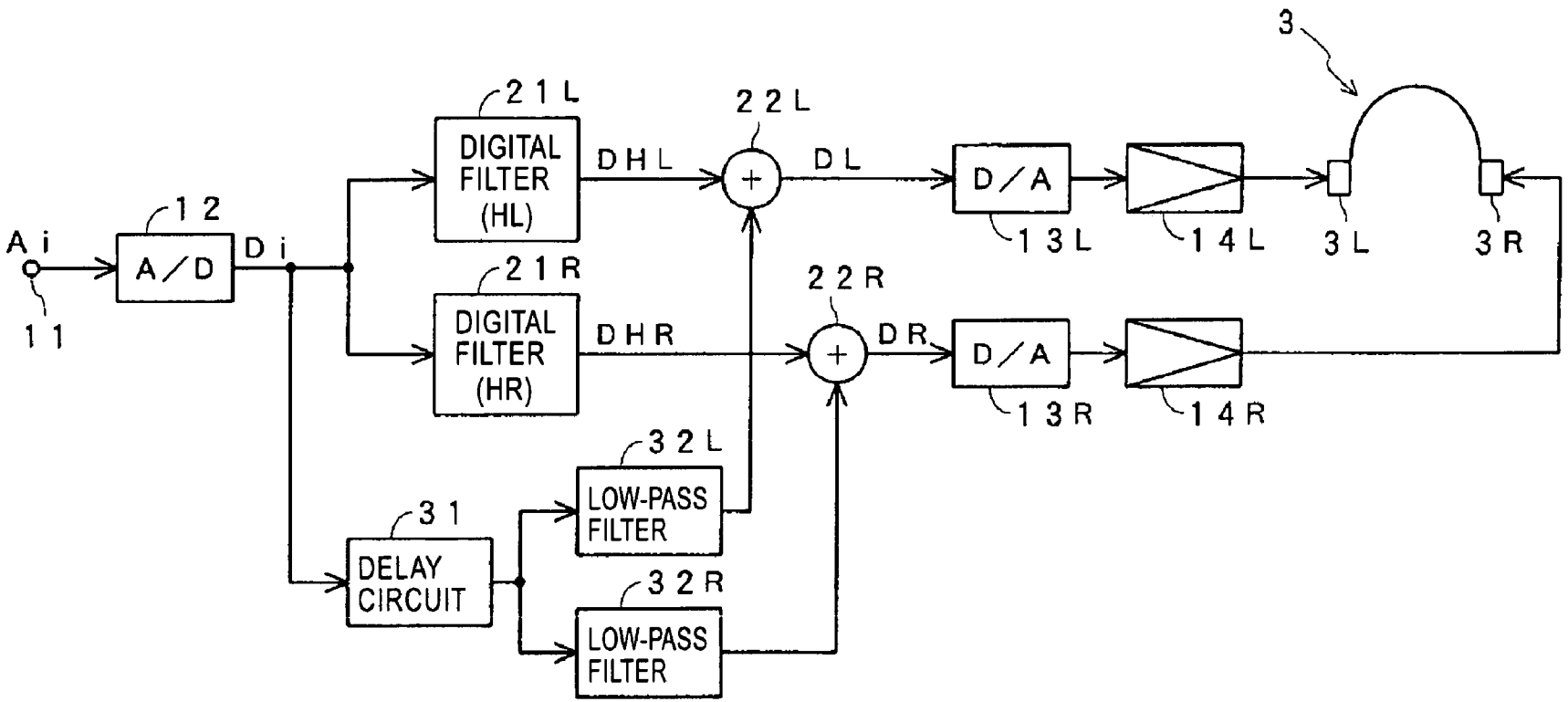
FIG. 9 is a block diagram showing a second audio reproducing apparatus according to the first embodiment.

In the case shown in FIG. 1, the low-pass filter 32 is shared by the paths to the right and left ears. As shown in FIG. 9, an audio reproducing apparatus according to the present invention may be configured such that an input audio signal Di delayed by a delay circuit 31 is sent to low-pass filters 32R and 32L, an adder circuit 22R adds the output signal of the low-pass filter 32R to the output signal DHR of a digital filter 21R, and an adder circuit 22L adds the output signal of the low-pass filter 32L to the output signal DHL of a digital filter 21L.

In this case, when the output signal levels of the low-pass filters 32R and 32L are adjusted according to the low-frequency responses of the digital filters 21R and 21L, the level difference at the low frequencies between the frequency characteristics of the output signals DR and DL of the adder circuits 22R and 22L is made smaller.

Figure 10:
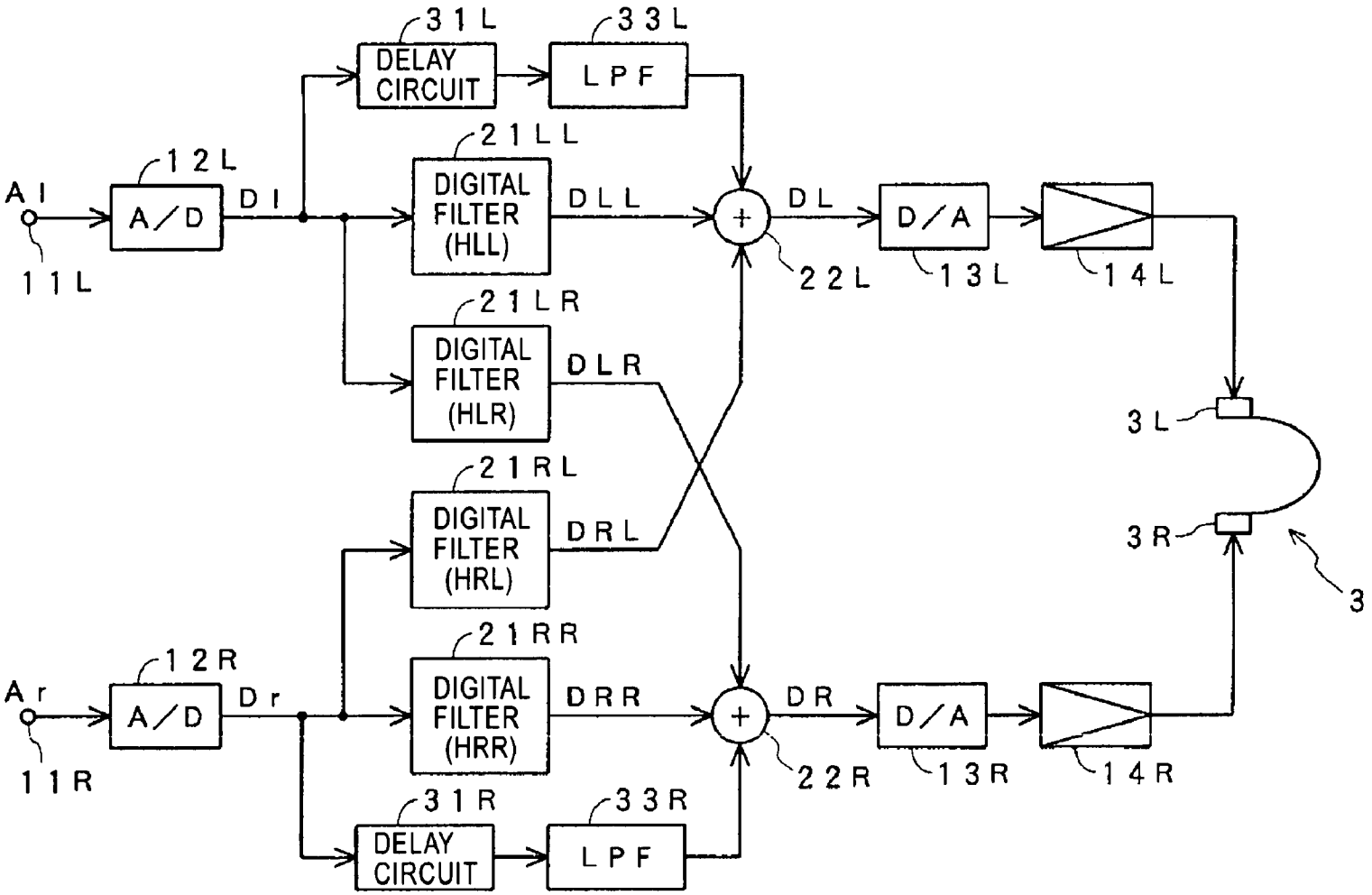
FIG. 10 is a block diagram showing a third audio reproducing apparatus according to the first embodiment.
Figure 11:
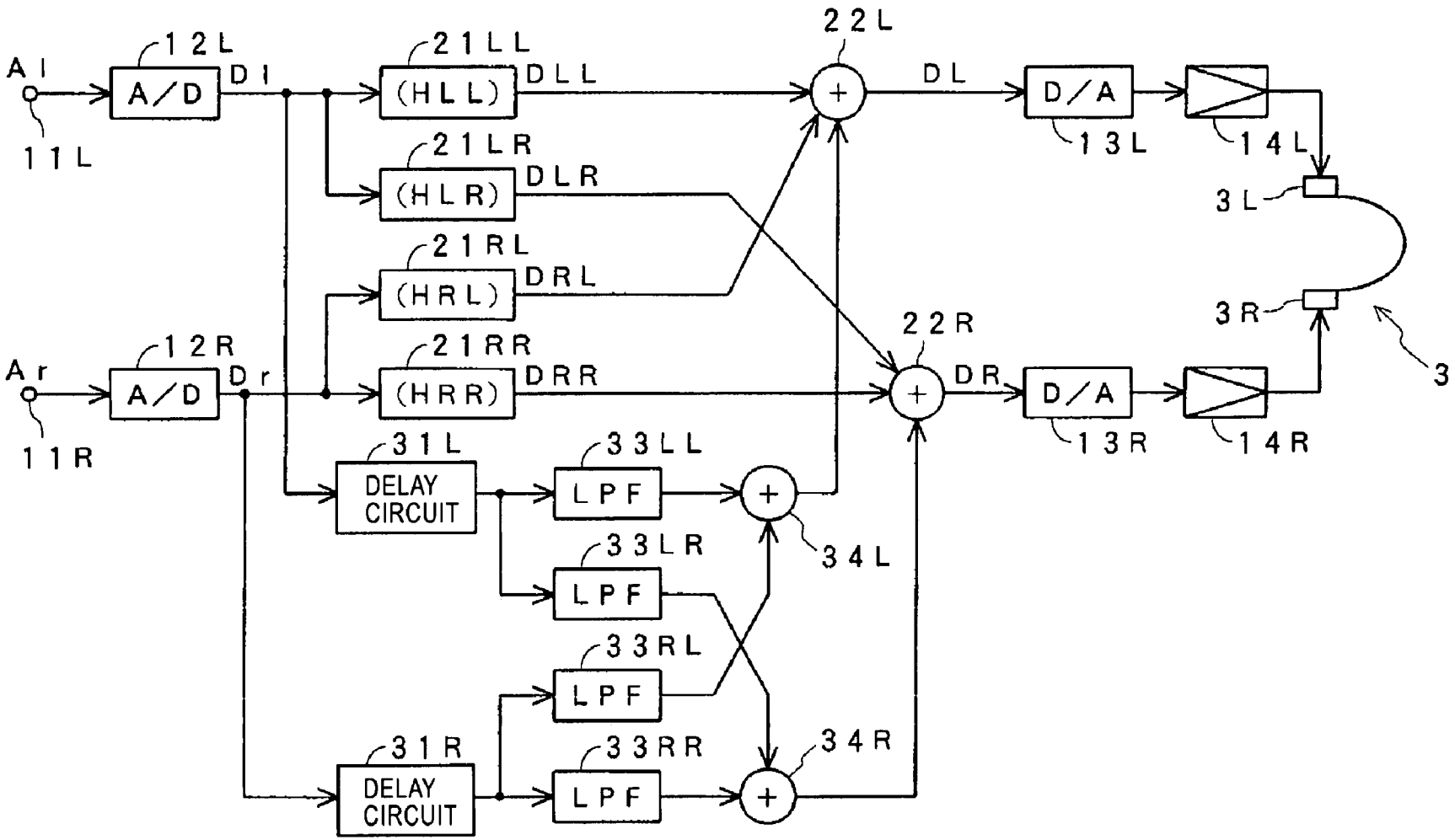
FIG. 11 is a block diagram showing a fourth audio reproducing apparatus according to the first embodiment.

[Stereo Reproduction by Headphones: FIG. 10 and FIG. 11]

Figure 22:
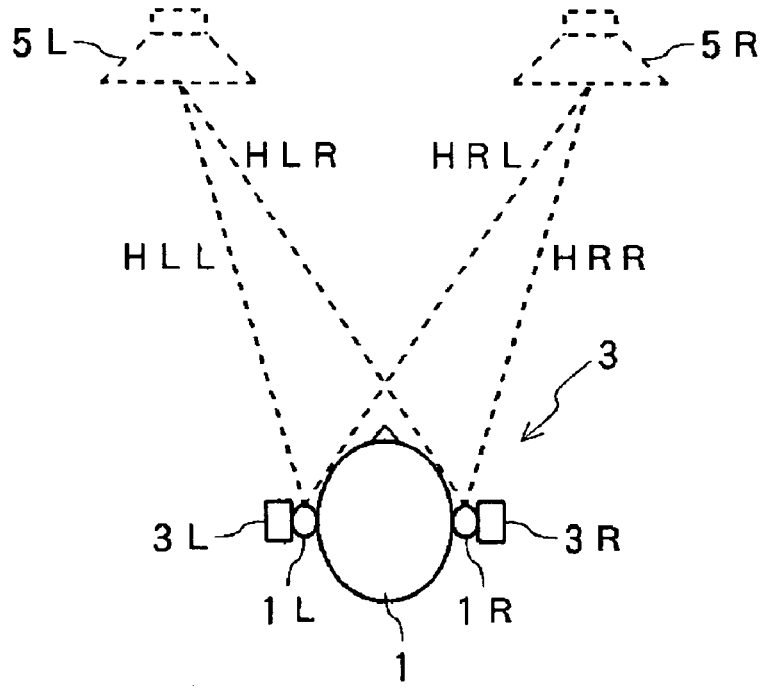
FIG. 22 is a view showing the principle of a case in which sound images are located at any positions outside the head of the listener.

FIG. 10 shows another case according to the first embodiment, in which two-channel stereo sound is reproduced by headphones with the sound images thereof being located at any positions outside the head of the listener, for example, at positions symmetrical against the center plane before the listener, as shown in FIG. 22.

In this case, transfer functions HRR and HRL from the position of a sound source 5R where one sound image is to be located, to the right and left ears 1R and 1L of the listener 1, and transfer functions HLR and HLL from the position of a sound source 5L where the other sound image is to be located, to the right and left ears 1R and 1L of the listener 1 are measured or calculated in advance.

In the case shown in FIG. 10, right-hand-side and left-hand-side analog audio signals Ar and Al corresponding to signals of the sound sources 5R and 5L shown in FIG. 22 are input to terminals 11R and 11L, and are converted to digital audio signals Dr and Dl by A/D converters 12R and 12L, the digital audio signal Dr is sent to digital filters 21RR and 21RL, and the digital audio signal Dl is sent to digital filters 21LR and 21LL.

The digital filters 21RR and 21RL convolute impulse responses to which the transfer functions HRR and HRL are converted in the time domain into the digital audio signal Dr. The digital filters 21LR and 21LL convolute impulse responses to which the transfer functions HLR and HLL are converted in the time domain into the digital audio signal Dl.

In the same way as in the cases shown in FIG. 1 and FIG. 9, the digital filters 21RR, 21RL, 21LR, and 21LL can be formed of an FIR filter such as that shown in FIG. 3. Alternatively, The digital filters 21RR and 21RL, or the is digital filters 21LR and 21LL can be configured such that they share the delay circuits 51 shown in FIG. 4.

In addition, in the same way as in the cases shown in FIG. 1 and FIG. 9, the digital filters 21RR, 21RL, 21LR, and 21LL can be configured such that they include software (program) like a DSP, as sound-image-locating signal processing sections.

In the case shown in FIG. 10, the digital audio signals Dr and Dl output from the A/D converters 12R and 12L are delayed by delay circuits 31R and 31L so as to match in time the output signals DRR, DRL, DLR, and DLL of the digital filters 21RR, 21RL, 21LR, and 21LL, and are sent to low-pass filters 33R and 33L, and low-frequency components, described later, are extracted from the digital audio signals Dr and Dl by the low-pass filters 33R and 33L.

Then, an adder circuit 22R adds the output signal of the low-pass filter 33R to the output signals DRR and DLR of the digital filters 21RR and 21LR. An adder circuit 22L adds the output signal of the low-pass filter 33L to the output signals DRL and DLL of the digital filters 21RL and 21LL. The output digital audio signals DR and DL of the adder circuits 22R and 22L are converted to analog audio signals by D/A converters 13R and 13L. The two-path analog audio signals are amplified by audio amplifier circuits 14R and 14L, and sent to the right-hand and left-hand acoustic transducers 3R and 3L of headphones 3.

The low-pass filters 33R and 33L have a frequency characteristic such that a low-frequency components having frequencies of several hundred Hz and lower is extracted at a constant level as shown in FIG. 7.

Therefore, also in the case shown in FIG. 10, when the output signal levels of the low-pass filters 33R and 33L are set relatively higher than the output signal levels of the digital filters 21RR, 21LR, 21RL, and 21LL, the output signals of the low-pass filters 33R and 33L become dominant at low frequencies of several hundred Hz and lower in the frequency characteristics of the output signals DR and DL of the adder circuits 22R and 22L. There is just a slight level difference between the output signal DR of the adder circuit 22R and the output signal DL of the adder circuit 22L, and a clear feeling of sound-image locating is obtained at the low frequencies.

As shown in a case of FIG. 11, an audio reproducing apparatus according to the present invention may be configured such that an input audio signal Dr delayed by a delay circuit 31R is sent to low-pass filters 33RR and 33RL, an input audio signal Dl delayed by a delay circuit 31L is sent to low-pass filters 33LR and 33LL, an adder circuit 34R adds the output signals of the low-pass filters 33RR and 33LR, an adder circuit 34L adds the output signals of the low-pass filters 33RL and 33LL, an adder circuit 22R adds the output signal of the adder circuit 34R to the output signals DRR and DLR of digital filters 21RR and 21LR, and an adder circuit 22L adds the output signal of the adder circuit 34L to the output signals DRL and DLL of digital filters 21RL and 21LL.

In the case shown in FIG. 11, if the low-pass filters 33RR and 33RL, and the low-pass filters 33LR and 33LL have the same characteristics, they can be shared. In addition, if the delay circuits 31R and 31L have the same delay time, either of them can be shared. In this case, when the input audio signals Dr and Dl are added, the obtained signal is sent through the shared delay circuit and the shared low-pass filters, and the resultant signals are added by the adder circuits 22R and 22L, the circuit scale can be made further smaller.

[Reproduction by Speakers]

Figure 23:
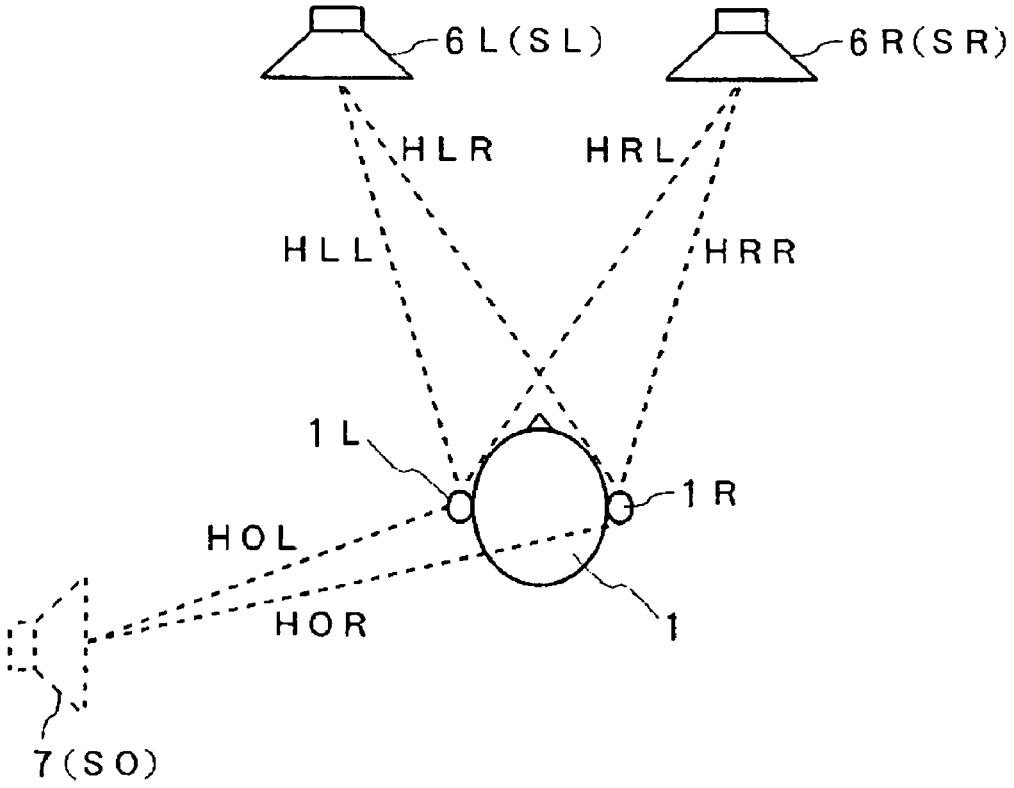
FIG. 23 is a view showing the principle of a case in which a sound image is located at any position around the listener.
Figure 24:
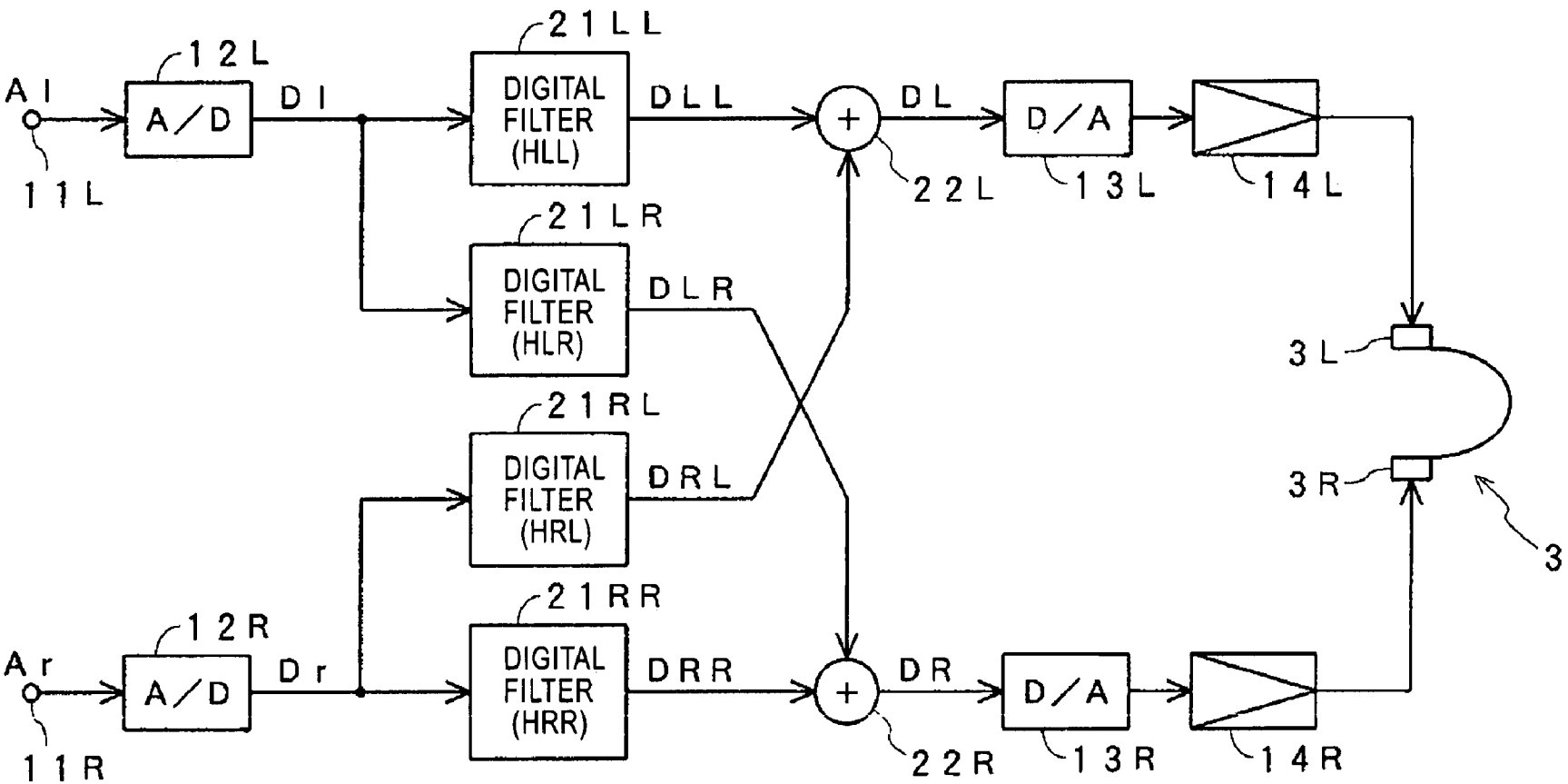
FIG. 24 is a block diagram of a conventional audio reproducing apparatus.

When sound is reproduced by speakers with the sound image being located at any position around the listener, as shown in FIG. 23, an audio reproducing apparatus can be configured as described in the first embodiment.

Figure 25:
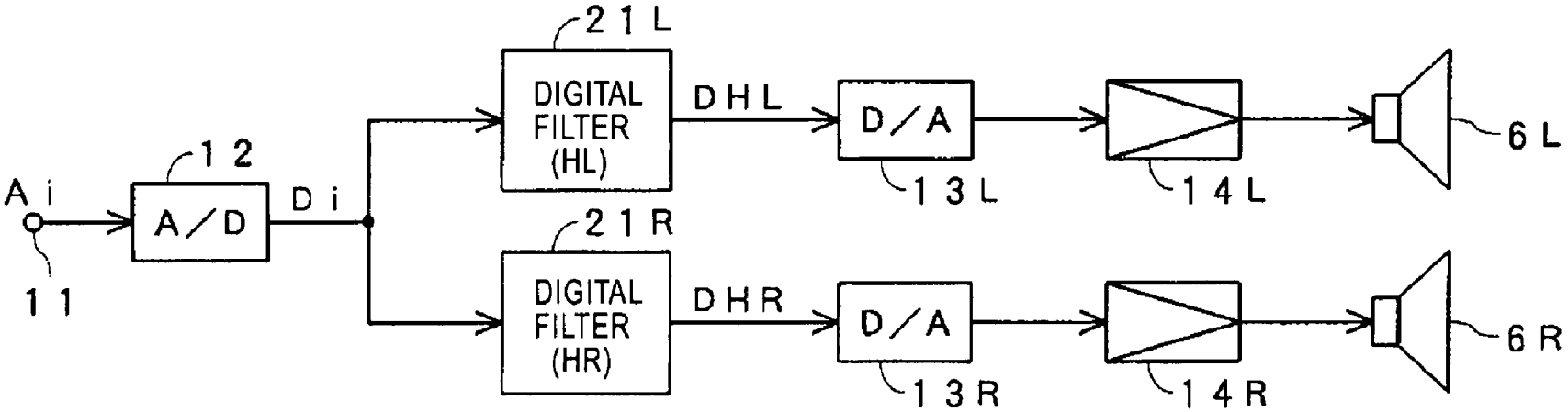
FIG. 25 is a block diagram of another conventional audio reproducing apparatus.

In this case, a low-pass filter is provided in addition to the structure shown in FIG. 25. The low-pass filter extracts a low-frequency component from the output audio signal Di of the A/D converter 12, and the low-frequency-component signal is added to the output signals DHR and DHL of the digital filters 21R and 21L. The resultant signals serve as the two-path digital audio signals, are converted to analog audio signals by the D/A converters 13R and 13L, and are sent to the speakers 6R and 6L.

[Second Embodiment: FIG. 12 to FIG. 16]

A case in which a reverberation processing is performed and a low-frequency component of an input audio signal are added to an impulse-response-output audio signal will be described below according to a second embodiment.

[Monaural Reproduction by Headphones: FIG. 12 to FIG. 15]

Figure 12:
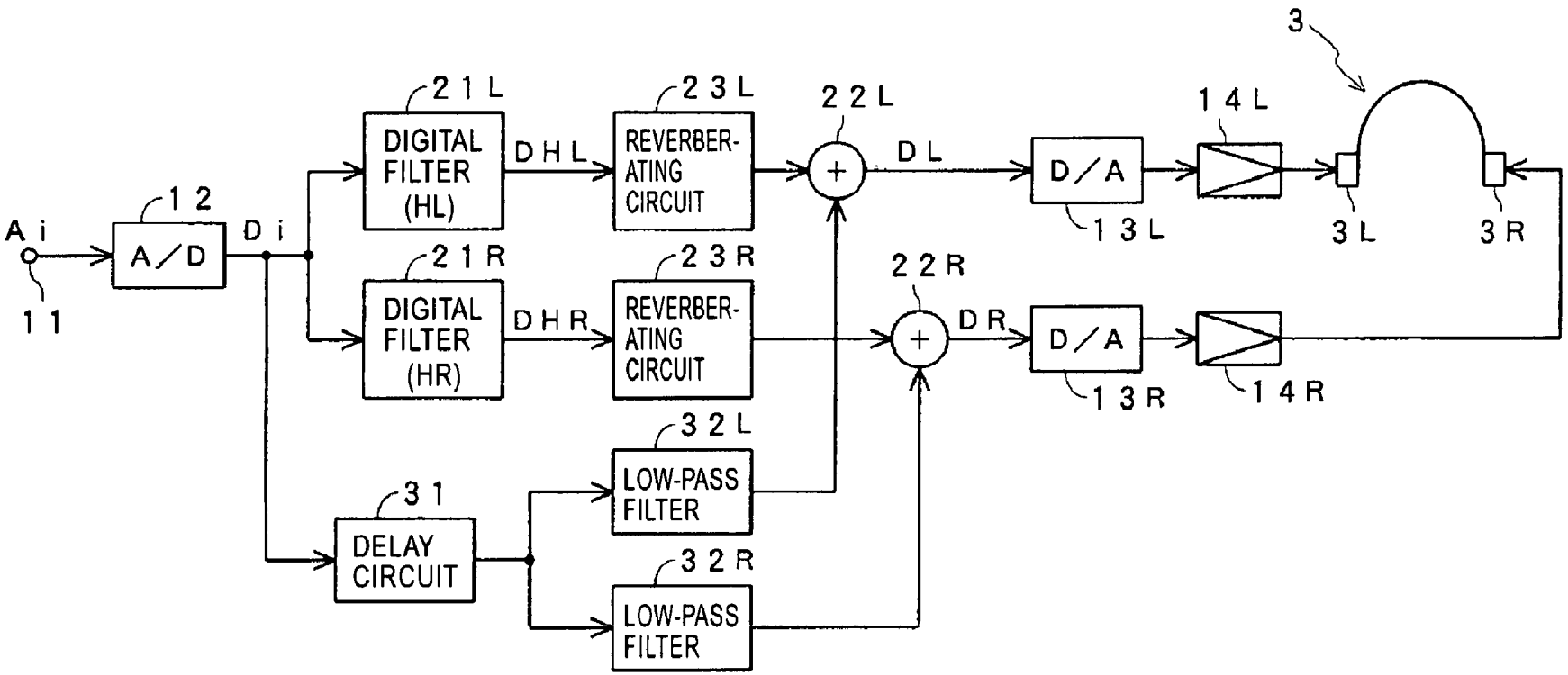
FIG. 12 is a block diagram showing a first audio reproducing apparatus according to a second embodiment.

FIG. 12 shows a case according to the second embodiment, in which one-channel sound is reproduced by headphones with the sound image thereof being located at any position outside the head of the listener, as shown in FIG. 21.

In the case shown in FIG. 12, the output signals DHR and DHL of digital filters 21R and 21L are sent to reverberating circuits 23R and 23L, and reverberation processes are performed to the output signals DHR and DHL. An adder circuit 22R adds the output signal of a low-pass filter 32R, which is the same as the low-pass filter 32R shown in FIG. 9, to the output signal of the reverberating circuit 23R, and an adder circuit 22L adds the output signal of a low-pass filter 32L, which is the same as the low-pass filter 32L shown in FIG. 9, to the output signal of the reverberating circuit 23L to obtain two-path digital audio signals DR and DL. The other structure is the same as in the case shown in FIG. 9.

Figure 13:
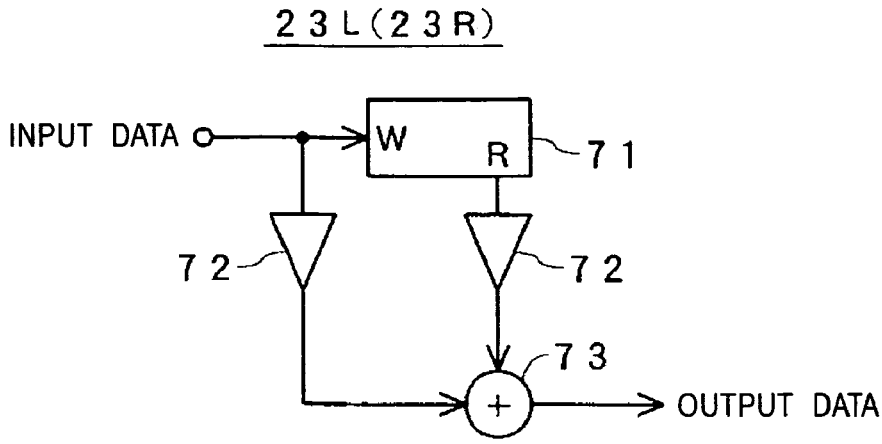
FIG. 13 is a block diagram of a reverberating circuit.

The reverberating circuits 23R and 23L have, for example, a structure in which input data is written into a delay memory 71 and read from the delay memory 71 to be delayed for a certain time, the input data and the delayed data are multiplied by coefficients by multiplier circuits 72, and the output data items of the multiplier circuits 72 are added by an adder circuit 73, as shown in FIG. 13.

Figure 14:
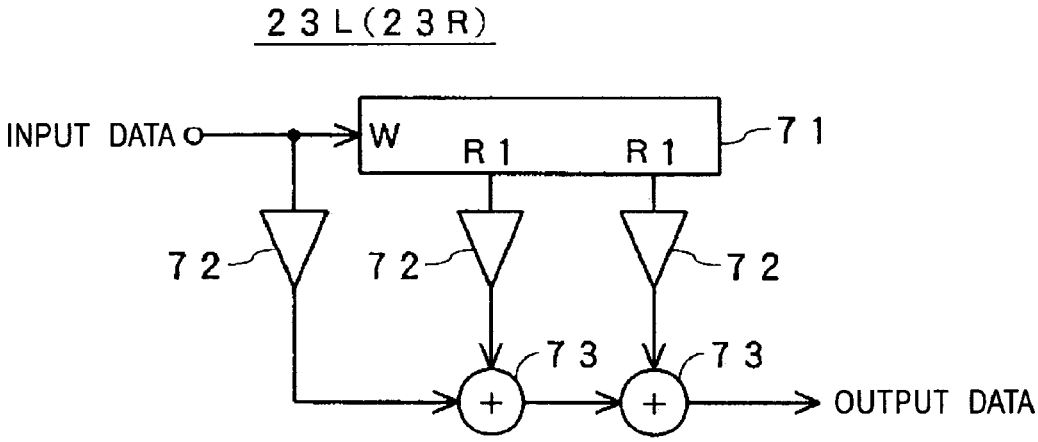
FIG. 14 is a block diagram of another reverberating circuit.

Alternatively, the reverberating circuits 23R and 23L have a structure in which input data is written into a delay memory 71 and two delayed data items having different delay periods of time are read from the delay memory 71, the input data and the two delayed data items are multiplied by coefficients by multiplier circuits 72, and the output data items of the multiplier circuits 72 are sequentially added by adder circuits 73, as shown in FIG. 14.

The reverberating circuits 23R and 23L can be configured together with the digital filters 21R and 21L such that they include software (program) like a DSP, as sound-image-locating signal processing sections.

When the reverberating circuits 23R and 23L performs the reverberation processing to the output signals DHR and DHL of the digital filters 21R and 21L, if the numbers of orders (taps) of the digital filters 21R and 21L are limited, the impulse responses produced by the digital filters 21R and 21L are substantially extended in time, a feeling of a sufficient distance is obtained even with a reproduction by headphones, and a feeling of sound-image locating similar to that obtained in a case in which a sound source is actually located around the listener.

Figure 15:
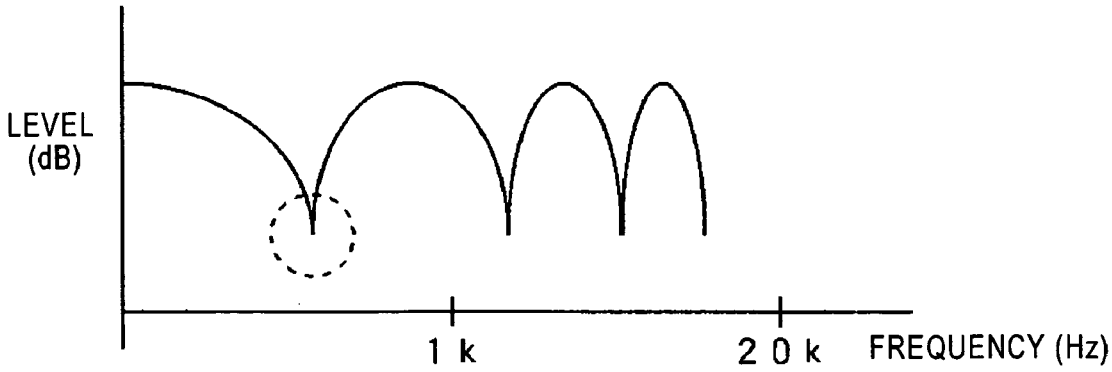
FIG. 15 is a view showing the frequency characteristic of an example reverberating circuit.

The reverberating circuits 23R and 23L have comb-tooth frequency characteristics as shown in FIG. 15. Although the frequency characteristics of the output signals of the reverberating circuits 23R and 23L are obtained by synthesizing the frequency characteristics of the digital filters 21R and 21L and the frequency characteristics of the reverberating circuits 23R and 23L, the comb-tooth frequency characteristics remain.

In the case shown in FIG. 12, low-pass filters 32R and 32L have frequency characteristics such that they extract a low-frequency component having frequencies of several hundred Hz and lower at a constant level, as shown in FIG. 7. The output signals of the low-pass filters 32R and 32L are added to the output signals of the reverberating circuits 23R and 23L, respectively.

Therefore, attenuation at a low frequency enclosed by a dotted line in FIG. 15 in the comb-tooth characteristics is reduced to reduce the deterioration of sound quality at low frequencies. In addition, in the same way as in the cases shown in FIG. 1 and FIG. 9, there is just a slight level difference at low frequencies of several hundred Hz and lower between the output signal DR of the adder circuit 22R and the output signal DL of the adder circuit 22L, and a clear feeling of sound-image locating is obtained at the low frequencies.

Figure 16:
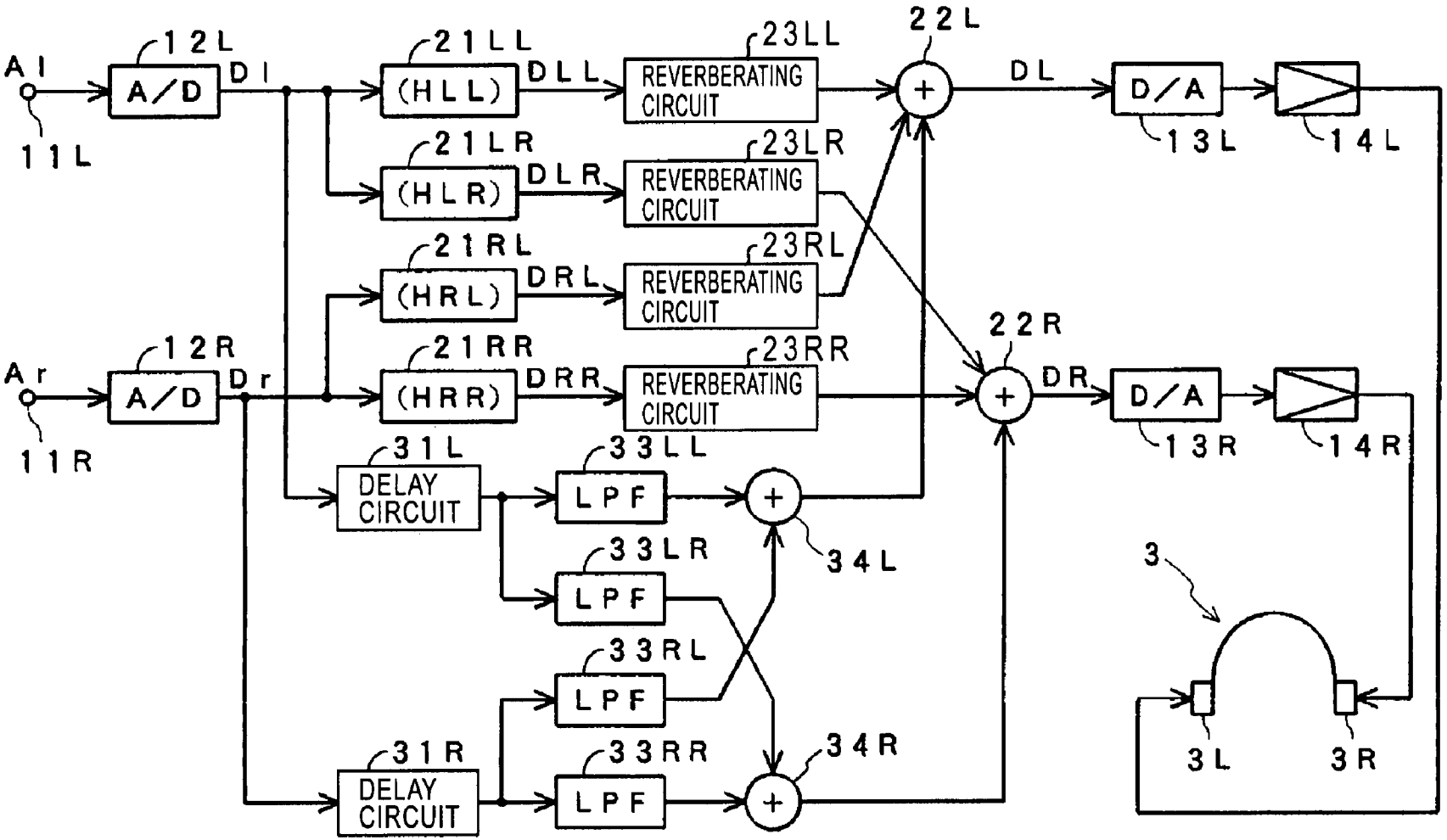
FIG. 16 is a block diagram showing a second audio reproducing apparatus according to the second embodiment.

[Stereo Reproduction by Headphones: FIG. 16]

FIG. 16 shows another case according to the second embodiment, in which two-channel stereo sound is reproduced by headphones with the sound images thereof being located at any positions outside the head of the listener, as shown in FIG. 22.

In the case shown in FIG. 16, the output signals DRR, DRL, DLR, and DLL of digital filters 21RR, 21RL, 21LR, and 21LL are sent to reverberating circuits 23RR, 23RL, 23LR, and 23LL, and reverberation processes are performed to the output signals DRR, DRL, DLR, and DLL. An adder circuit 22R adds the output signal of an adder circuit 34R, which is the same as the adder circuit 34R shown in the case of FIG. 11, to the output signals of the reverberating circuits 23RR and 23LR, and an adder circuit 22L adds the output signal of an adder circuit 34L, which is the same as the adder circuit 34L shown in the case of FIG. 11, to the output signals of the reverberating circuits 23RL and 23LL to obtain two-path digital audio signals DR and DL.

The other structure is the same as in the case shown in FIG. 11. Also in this case, as described above, a low-pass filter and delay circuits can be shared to reduce the circuit scale.

Therefore, also in the case of FIG. 16, the impulse responses produced by the digital filters 21RR, 21RL, 21LR, and 21LL can be substantially extended in time, in the same way as in the case shown in FIG. 12. A feeling of a sufficient distance is obtained even with a reproduction by headphones, and a clear feeling of sound-image locating is obtained at low frequencies.

[Reproduction by Speakers]

When sound is reproduced by speakers with the sound image being located at any position around the listener, as shown in FIG. 23, an audio reproducing apparatus can be configured as described in the second embodiment.

[Third Embodiment: FIG. 17 to FIG. 20]

A case in which down-sampling or bandwidth restriction is applied to an input audio signal, and an impulse response is convoluted will be described according to a third embodiment.

Figure 17:
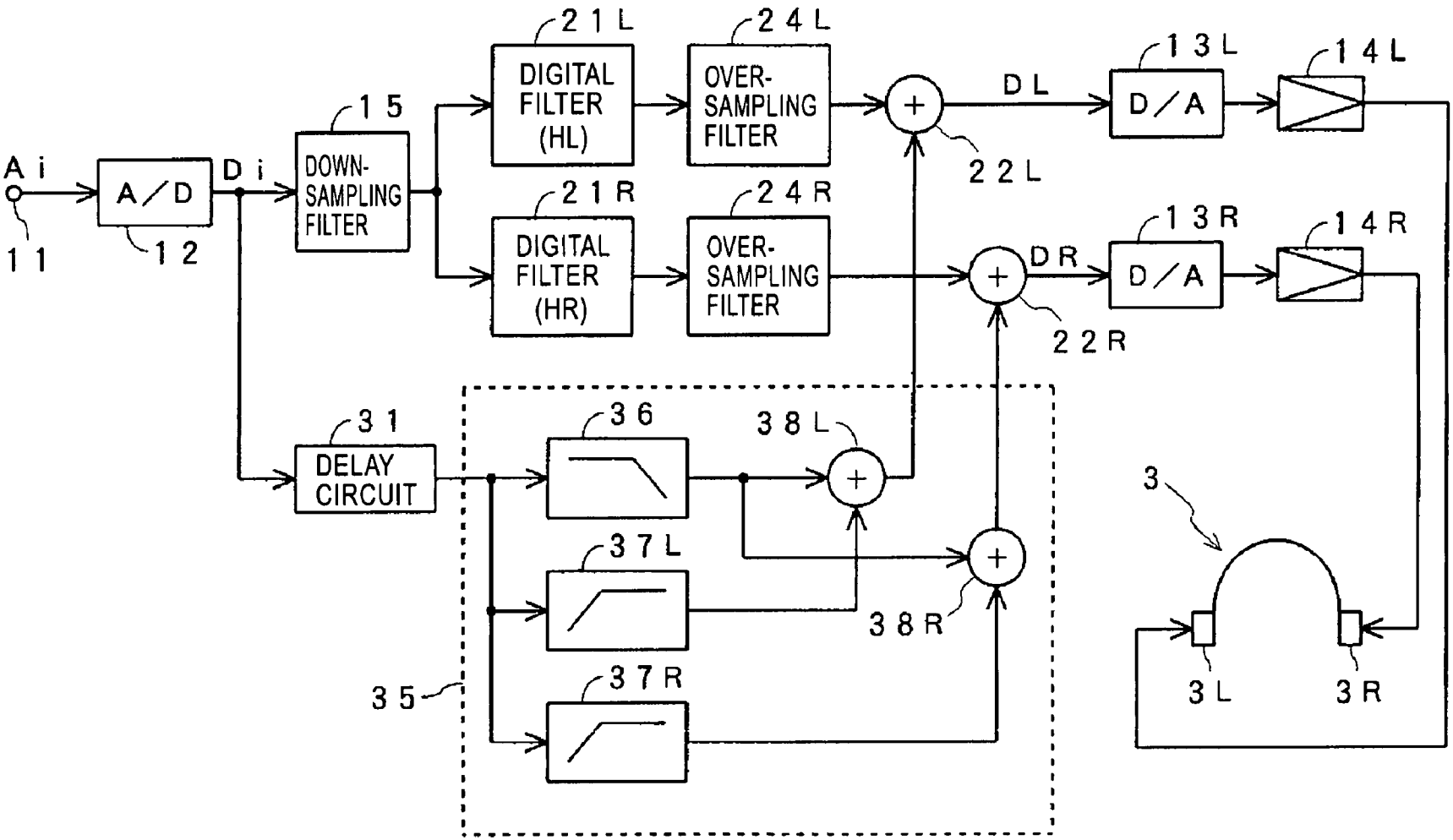
FIG. 17 is a block diagram showing a first audio reproducing apparatus according to a third embodiment.
Figure 18:
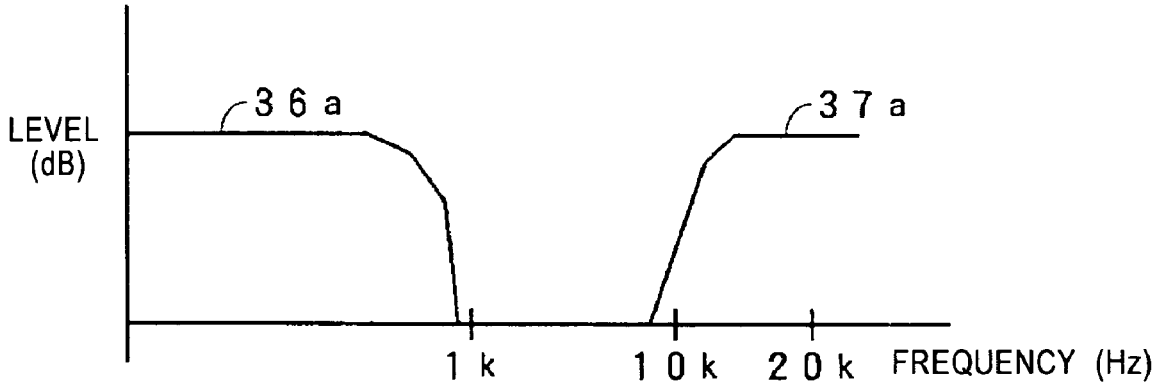
FIG. 18 is a view showing the frequency characteristic of a filter section in the audio reproducing apparatus shown in FIG. 17.
Figure 19:
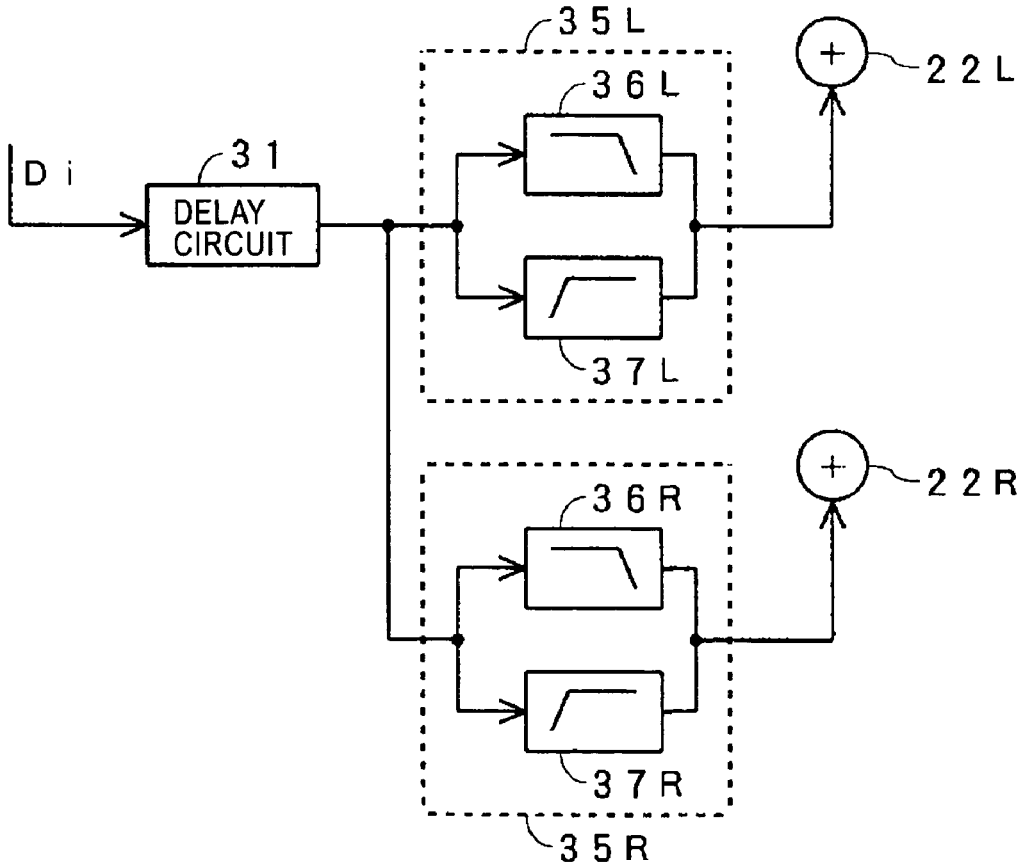
FIG. 19 is a block diagram of another filter section in the audio reproducing apparatus shown in FIG. 17.

[When Down-Sampling is Applied: FIG. 17 to FIG. 19]

FIG. 17 shows a case according to the third embodiment, in which, when one-channel sound is reproduced by headphones with the sound image thereof being located at any position outside the head of the listener, as shown in FIG. 21, the input audio signal is down-sampled and an impulse response is convoluted.

In the case shown in FIG. 17, the output digital audio signal Di of an A/D converter 12 is sent to a down-sampling filter 15, and the sampling frequency of the digital audio signal is reduced to a half of the original frequency, for example, converted from 44.1 kHz to 22.05 kHz. The digital audio signal to which down-sampling has been applied is sent to digital filters 21R and 21L.

The digital filters 21R and 21L convolute the impulse responses to which the above-described transfer functions HR and HL are converted in the time domain, into the digital audio signal to which down-sampling has been applied.

The output digital audio signals of the digital filters 21R and 21L are sent to over-sampling filters 24R and 24L, and the sampling frequency of the digital audio signals is returned to the original frequency, for example, converted from 22.05 kHz to 44.1 kHz.

The output digital audio signal Di of the A/D converter is also delayed by a delay circuit 31 so as to match in time the output signals of the over-sampling filters 24R and 24L, and sent to a filter section 35.

The filter section 35 is formed, in this case, of a low-pass filter 36 for extracting a low-frequency component from the output audio signal of the delay circuit 31, and high-pass filters 37R and 37L for extracting high-frequency components from the output audio signal of the delay circuit 31. An adder circuit 38R adds the output signals of the low-pass filter 36 and the high-pass filter 37R, and an adder circuit 38L adds the output signals of the low-pass filter 36 and the high-pass filter 37L.

An adder circuit 22R adds the output signal of the adder circuit 38R to the output signal of the over-sampling filter 24R, and an adder circuit 22L adds the output signal of the adder circuit 38L to the output signal of the over-sampling filter 24L. The output digital audio signals DR and DL of the adder circuits 22R and 22L are converted to analog audio signals by D/A converters 13R and 13L, and the two-path analog audio signals are amplified by audio amplifier circuits 14R and 14L, and sent to the right-hand and left-hand acoustic transducers 3R and 3L of headphones 3.

Since the digital audio signals input to the digital filters 21R and 21L have a lower sampling frequency than the original digital audio signal Di in the current case, the impulse responses produced by the digital filters 21R and 21L are extended in time in an equivalent manner.

When the sampling frequency is reduced to its half as described above, for example, if the numbers of orders of the digital filters 21R and 21L are the same as in the cases shown in FIG. 1 and FIG. 9, the time lengths of the impulse responses produced by the digital filters 21R and 21L are twice as long as that of the cases shown in FIG. 1 and FIG. 9. Contrary, if the numbers of orders of the digital filters 21R and 21L are set to a half of that of the cases shown in FIG. 1 and FIG. 9, the time lengths of the impulse responses produced by the digital filters 21R and 21L are the same as that of the cases shown in FIG. 1 and FIG. 9.

Therefore, even when the numbers of orders of the digital filters 21R and 21L are limited, the impulse responses of the digital filters 21R and 21L can be extended in time. A feeling of a sufficient distance is obtained even with a reproduction by headphones, and a feeling of sound-image locating similar to that obtained when the sound source is actually located around the listener is obtained.

When the sampling frequency is reduced in this way, since the down-sampling filter 15 removes distortion caused by aliasing, the bandwidth of an input audio signal is limited. When the sampling frequency is halved, for example, the bandwidth of an input audio signal is restricted from 0 to 20 kHz to 0 to 10 kHz.

Therefore, in the case shown in FIG. 17, the adder circuits 22R and 22L add the low-frequency component and the high-frequency components of the audio signal Di delayed by the delay circuit 31 to the output audio signals of the over-sampling filters 24R and 24L.

In this case, the low-pass filter 36 extracts a low-frequency component having frequencies of several hundred Hz and lower from the audio signal Di delayed by the delay circuit 31 at a constant level, as shown in a frequency characteristic 36*a* of FIG. 18, and the high-pass filters 37R and 37L extract a high-frequency component having frequencies of 10 kHz and higher from the audio signal Di delayed by the delay circuit 31, as shown in a frequency characteristic 37*a* of FIG. 18.

As shown in FIG. 5B and FIG. 5A, in the frequency characteristics of impulse responses from an actual sound source to the right and left ears of the listener, measured in a general listening room, especially at low frequencies of several hundred Hz and lower, there is no large level difference between the impulse response from the sound source to the right ear and the impulse response from the sound source to the left ear. At high frequencies of 10 kHz and higher, there is a large level difference between the impulse response from the sound source to the right ear and the impulse response from the sound source to the left ear, depending on a sound-source direction.

Therefore, it is preferred as in the case shown in FIG. 17 that the right-hand-side high-pass filter 37R and the left-hand-side high-pass filter 37L be separately provided and their output signal levels be changed according to the above-described level difference.

With this, high-frequency components removed by the bandwidth restriction at the down-sampling filter 15 are compensated for. In addition, in the same way as in the case of FIG. 1, the output signal of the low-pass filter 36 becomes dominant at low frequencies of several hundred Hz and lower, and there becomes a slight level difference between the output signal DR of the adder circuit 22R and the output signal DL of the adder circuit 22L. A clear feeling of sound-image locating is obtained at the low frequencies, attenuation at the low frequencies is reduced, and the deterioration of sound quality at the low frequencies is reduced.

The filter section 35 shown in FIG. 17 may be configured, as shown in FIG. 19, such that it is formed of a right-hand-side filter section 35R and a left-hand-side filter section 35L, the right-hand-side filter section 35R includes a low-pass filter 36R and a high-pass filter 37R, and the left-hand-side filter section 35L includes a low-pass filter 36L and a high-pass filter 37L.

With this, when the output signal levels of the low-pass filters 36R and 36L are adjusted, a level difference at the low frequencies in the frequency characteristics of the output signals DR and DL of the adder circuits 22R and 22L are made further smaller, in the same way as in the case of FIG. 9 or FIG. 12.

Such filters for extracting low-frequency components and high-frequency components can be formed of FIR filters such as that shown in FIG. 3 or infinite-impulse-response (IIR) filters.

In the above-described case, high-frequency components removed by the bandwidth restriction at the down-sampling filter 15 are compensated for. When high-frequency components having frequencies of 10 kHz and higher are not necessary, the filter section 35 may be formed of only the low-pass filter 36, or only the low-pass filters 36R and 36L.

When two-channel stereo sound is reproduced by a headphone with the sound images thereof being located at any positions outside the head of the listener, as shown in FIG. 22, or when sound is reproduced by speakers with the sound image being located at any position around the listener, as shown in FIG. 23, the structure in the above-described case can be used.

Figure 20:
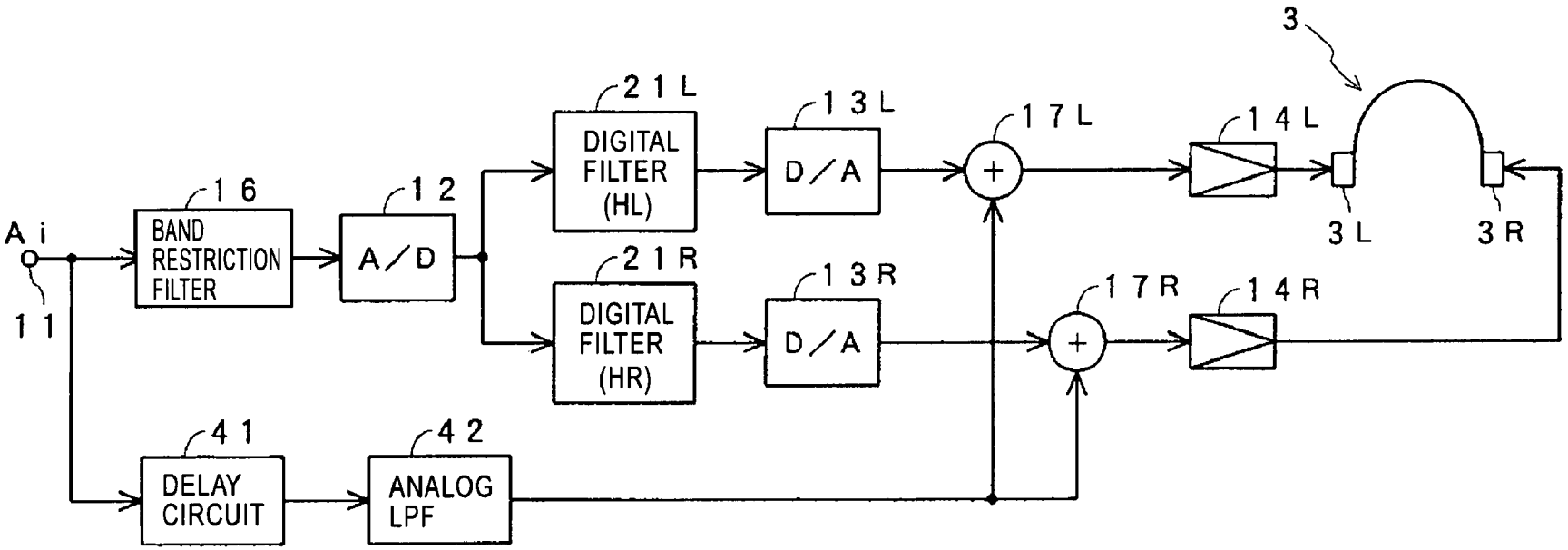
FIG. 20 is a block diagram showing a second audio reproducing apparatus according to the third embodiment.

[When Band Restriction is Applied: FIG. 20]

FIG. 20 shows a case according to the third embodiment, in which, when one-channel sound is reproduced by headphones with the sound image thereof being located at any position outside the head of the listener, as shown in FIG. 21, a band restriction is applied to the input audio signal and an impulse response is convoluted.

In the case shown in FIG. 20, an analog audio signal Ai is input to a terminal 11 and is sent to a band-restriction filter (low-pass filter) 16. Only a frequency component having frequencies of 10 kHz and lower is extracted from the audio signal Ai. The analog audio signal having a restricted bandwidth of 0 to 10 kHz is converted to a digital audio signal by an A/D converter 12, and the digital audio signal is sent to digital filters 21R and 21L.

The digital filters 21R and 21L convolute impulse responses to which the above-described transfer functions HR and HL are converted in the time domain, into the digital audio signal to which band restriction has been applied.

Therefore, even when the numbers of orders (taps) of the digital filters 21R and 21L are limited, the impulse responses produced by the digital filters 21R and 21L can be extended in time in an equivalent manner. A feeling of a sufficient distance is obtained even with a reproduction by headphones, and a feeling of sound-image locating similar to that obtained when a sound source is actually located around the listener is obtained.

In the current case, the output digital audio signals of the digital filters 21R and 21L are converted to analog audio signals by D/A converters 13R and 13L. The analog audio signal Ai input to the terminal 11 is delayed by a delay circuit 41 so as to match in time the output analog audio signals of the D/A converters 13R and 13L, and sent to a low-pass filter 42. The low-pass filter 42 extracts a low-frequency component having frequencies of several hundred Hz and lower from the analog audio signal Ai. An adder circuit 17R adds the output signal of the low-pass filter 42 to the output signal of the D/A converter 13R, and an adder circuit 17L adds the output signal of the low-pass filter 42 to the output signal of the D/A converter 13L. The output analog audio signals of the adder circuits 17R and 17L are amplified by audio amplifier circuits 14R and 14L, and sent to the right-hand and left-hand acoustic transducers 3R and 3L of headphones 3.

Therefore, the output signal of the low-pass filter 42 becomes dominant at low frequencies of several hundred Hz and lower in the frequency characteristics of the output signals of the adder circuits 17R and 17L, and there becomes a slight level difference between the output signal of the adder circuit 17R and the output signal of the adder circuit 17L. A clear feeling of sound-image locating is obtained at the low frequencies, attenuation at the low frequencies is reduced, and the deterioration of sound quality at the low frequencies is also reduced.

In the current case, instead of the analog audio signal Ai, the output signal of the band-restriction filter 16 may be sent to the delay circuit 41.

When two-channel stereo sound is reproduced by headphones with the sound images thereof being located at any positions outside the head of the listener, as shown in FIG. 22, or when sound is reproduced by speakers with the sound image being located at any position around the listener, as shown in FIG. 23, the structure in the above-described case can be used.

[Other Embodiments]

In each case of the above-described embodiments, an impulse response is convoluted into an input digital audio signal. The present invention can be also applied to cases in which an impulse response is convoluted into an input analog audio signal except a case in which an input digital audio signal is down-sampled as in the case shown in FIG. 17.

The circuit scale and the amount of calculation of a low-pass filter used in each case of the above-described embodiments can be further suppressed by using an IIR filter. When the present invention is applied to an analog signal, a simple CR filter can be used.

What is claimed is:

1. An audio reproducing apparatus comprising:

first filtering means for convoluting into an digital input audio signal, an impulse response to which a transfer function from a position where the sound image of the input audio signal is located to the left ear of a listener is converted on a time domain;

second filtering means for convoluting into said input digital audio signal, an impulse response to which a transfer function from the position where the sound image of the input audio signal is located to the right ear of the listener is converted on the time domain;

a delay circuit for delaying said input digital audio signal by a predetermined period and producing a delayed output signal;

third filtering means for extracting a low-frequency component from the delayed output signal;

wherein the third filtering means comprises a first low-pass filter and a second low-pass filter, and the third filtering means sends the output signal of the first low-pass filter to the first adder means, and sends the output signal of the second low-pass filter to the second adder means;

first adder means for adding the output signal of said second low-pass filter of the third filtering means to the output signal of the first filtering means to obtain a first output audio signal; and second adder means for adding the output signal of said second low-pass filter of the third filtering means to the output signal of the second filtering means to obtain a second output audio signal.

2. An audio reproducing apparatus comprising:

first filtering means for convoluting into an input digital audio signal, an impulse response to which a transfer function from a position where the sound image of the input audio signal is located to the left ear of a listener is converted on a time domain;

first reverberating means for performing a reverberation processing to the output signal of the first filtering means;

second filtering means for convoluting into said input digital audio signal, an impulse response to which a transfer function from the position where the sound image of the input audio signal is located to the right ear of the listener is converted on the time domain;

second reverberating means for performing a reverberation processing to the output signal of the second filtering means;

a delay circuit for delaying said input digital audio signal by a predetermined period and producing a delayed output signal;

third filtering means for extracting a low-frequency component from the delayed output signal;

wherein the third filtering means comprises a first low-pass filter and a second low-pass filter, and the third filtering means sends the output signal of the first low-pass filter to the first adder means, and sends the output signal of the second low-pass filter to the second adder means;

first adder means for adding the output signal of said first low-pass filter of the third filtering means to the output signal of the first reverberating means to obtain a first output audio signal; and second adder means for adding the output signal of said second low-pass filter of the third filtering means to the output signal of the second reverberating means to obtain a second output audio signal.

3. An audio reproducing apparatus comprising:

down-sampling means for down-sampling an input digital audio signal to generate a digital audio signal having a sampling frequency lower than the sampling frequency of the input digital audio signal;

first filtering means for convoluting into the down-sampled digital audio signal, an impulse response to which a transfer function from a position where the sound image of the digital audio signal is located to the left ear of a listener is converted on a time domain;

first over-sampling means for converting the sampling frequency of the output signal of the first filtering means to the sampling frequency of the input digital audio signal;

second filtering means for convoluting into the down-sampled digital audio signal, an impulse response to which a transfer function from the position where the sound image of the digital audio signal is located to the right ear of the listener is converted on the time domain;

second over-sampling means for converting the sampling frequency of the output signal of the second filtering means to the sampling frequency of the input digital audio signal;

third filtering means for extracting at least a low-frequency component and a high frequency component from the input digital audio signal;

first adder means for adding the output signal of the third filtering means to the output signal of the first over-sampling means to obtain a first output audio signal; and second adder means for adding the output signal of the third filtering means to the output signal of the second over-sampling means to obtain a second output audio signal;

wherein the third filtering means comprises a first low-pass filter and a second low-pass filter, and the third filtering means sends the output signal of the first low-pass filter to the first adder means, and sends the output signal of the second low-pass filter to the second adder means.

* * * * *